US011179935B2

(12) United States Patent
Nakagawa et al.

(10) Patent No.: US 11,179,935 B2
(45) Date of Patent: Nov. 23, 2021

(54) LIQUID EJECTION HEAD, LIQUID EJECTION MODULE, AND METHOD OF MANUFACTURING LIQUID EJECTION HEAD

(71) Applicant: CANON KABUSHIKI KAISHA, Tokyo (JP)

(72) Inventors: Yoshiyuki Nakagawa, Kawasaki (JP); Akiko Hammura, Tokyo (JP); Shinji Kishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/793,223

(22) Filed: Feb. 18, 2020

(65) Prior Publication Data

US 2020/0262201 A1 Aug. 20, 2020

(30) Foreign Application Priority Data

Feb. 19, 2019 (JP) ..... JP2019-027393
Jun. 5, 2019 (JP) ..... JP2019-105340

(51) Int. Cl.
*B41J 2/05* (2006.01)
*B41J 2/14* (2006.01)
*B41J 2/16* (2006.01)

(52) U.S. Cl.
CPC ..... *B41J 2/14145* (2013.01); *B41J 2/14201* (2013.01); *B41J 2/1601* (2013.01);
(Continued)

(58) Field of Classification Search
None
See application file for complete search history.

(56) References Cited

U.S. PATENT DOCUMENTS 8,235,505 B2 * 8/2012 Xie ..... B41J 2/14 347/54
8,685,763 B2 * 4/2014 Takahashi ..... B81C 1/00626 438/21

(Continued)

FOREIGN PATENT DOCUMENTS

EP 0 737 580 A2 10/1996
EP 0 819 532 A2 1/1998

(Continued)

OTHER PUBLICATIONS

Extended European Search Report dated Jun. 23, 2020, in European Patent Application No. 20158225.1.

(Continued)

*Primary Examiner* — Erica S Lin
*Assistant Examiner* — Tracey M McMillion
(74) *Attorney, Agent, or Firm* — Venable LLP

(57) ABSTRACT

In a liquid ejection head, a substrate is provided with a first inflow port located on an upstream side of a pressure chamber with respect to a direction of flow of liquids in a liquid flow passage and configured to allow a first liquid to flow into the liquid flow passage, a second inflow port located on the upstream side of the first inflow port and configured to allow a second liquid to flow into the liquid flow passage, and a lateral wall extending in a direction of extension of the liquid flow passage. At least part of the lateral wall is located above the first inflow port. In the pressure chamber, the first liquid flows in contact with a pressure generating element while the second liquid flows closer to the ejection port than the first liquid does.

19 Claims, 23 Drawing Sheets

(52) U.S. Cl.
CPC ..... *B41J 2/1607* (2013.01); *B41J 2/1637* (2013.01); *B41J 2002/14419* (2013.01)

(56) References Cited

U.S. PATENT DOCUMENTS

| | | | | |
|---|---|---|---|---|
| 10,538,087 | B2 | 1/2020 | Nakagawa et al. | |
| 2009/0133256 | A1* | 5/2009 | Okano | B41J 2/1631 29/890.1 |
| 2019/0009554 | A1 | 1/2019 | Nakagawa | |
| 2019/0023016 | A1 | 1/2019 | Nakagawa et al. | |
| 2020/0039210 | A1 | 2/2020 | Nakagawa et al. | |
| 2020/0039218 | A1 | 2/2020 | Nakagawa et al. | |
| 2020/0039219 | A1 | 2/2020 | Nakagawa et al. | |
| 2020/0039223 | A1 | 2/2020 | Nakagawa et al. | |

FOREIGN PATENT DOCUMENTS

| | | | |
|---|---|---|---|
| JP | 05-169663 | A | 7/1993 |
| JP | 06-305143 | A | 11/1994 |
| WO | 2009/004318 | A1 | 1/2009 |

OTHER PUBLICATIONS

U.S. Appl. No. 16/682,120, filed Nov. 13, 2019, Yoshiyuki Nakagawa Kazuhiro Yamada Takuro Yamazaki Toru Nakakubo Ryo Kasai.
U.S. Appl. No. 16/789,800, filed Feb. 13, 2020, Yoshiyuki Nakagawa Akiko Hammura.

* cited by examiner

FFIG.18G

LIQUID EJECTION HEAD, LIQUID EJECTION MODULE, AND METHOD OF MANUFACTURING LIQUID EJECTION HEAD

BACKGROUND OF THE DISCLOSURE

Field of the Disclosure

This disclosure relates to a liquid ejection head, a liquid ejection module, and a method of manufacturing a liquid ejection head.

Description of the Related Art

Japanese Patent Laid-Open No. H06-305143 discloses a liquid ejection unit configured to bring a liquid serving as an ejection medium and a liquid serving as a bubbling medium into contact with each other at an interface, and to eject the ejection medium along with growth of a bubble generated in the bubbling medium as a consequence of imparting thermal energy. Japanese Patent Laid-Open No. H06-305143 also discloses formation of a flow by applying a pressure to one or both of the ejection medium and the bubbling medium.

However, Japanese Patent Laid-Open No. H06-305143 lacks a detailed description of a configuration of a confluence unit for the two types of liquids. Accordingly, depending on the shape of an inflow portion for a liquid to flow into a liquid flow passage inclusive of a pressure chamber, an interface may be formed across which the bubbling medium and the ejection medium flow side by side in a width direction (horizontal direction) orthogonal to a direction of flow of the liquids in the liquid flow passage. In this case, there is a risk of unstable ejection of the liquid serving as the ejection medium because the liquid serving as the ejection medium may fail to come into contact with an ejection port.

SUMMARY OF THE DISCLOSURE

In view of the above circumstances, this disclosure aims to stabilize ejection of a liquid serving as an ejection medium by causing a liquid serving as a bubbling medium and the liquid serving as the ejection medium to flow while being arranged in a height direction in a pressure chamber, the height direction being a direction of ejection of the liquid serving as the ejection medium from an ejection port.

A liquid ejection head according to an aspect of this disclosure includes a substrate including a pressure generating element configured to apply pressure to a first liquid, a member provided with an ejection port configured to eject a second liquid, a pressure chamber including the ejection port and the pressure generating element, and a liquid flow passage which is formed by using the substrate and the member stacked on the substrate, includes the pressure chamber, and extends at least in a direction of flow of the first liquid and the second liquid. The substrate includes a first inflow port located on an upstream side of the pressure chamber in the direction of flow of the liquids in the liquid flow passage and configured to allow the first liquid to flow into the liquid flow passage, a second inflow port located on the upstream side of the first inflow port and configured to allow the second liquid to flow into the liquid flow passage, and a lateral wall extending in a direction of extension of the liquid flow passage, at least part of the lateral wall being located above the first inflow port. In the pressure chamber, the first liquid flows in contact with the pressure generating element and the second liquid flows closer to the ejection port than the first liquid does.

Further features of the present invention will become apparent from the following description of exemplary embodiments with reference to the attached drawings.

BRIEF DESCRIPTION OF THE DRAWINGS

FIGS. 18A to 18H are diagrams for explaining a method of manufacturing an element board including a confluence wall;

DESCRIPTION OF THE EMBODIMENTS

Now, liquid ejection heads and liquid ejection apparatuses according to embodiments of this disclosure will be described below with reference to the drawings.

First Embodiment (Configuration of Liquid Ejection Head)

Figure 1:
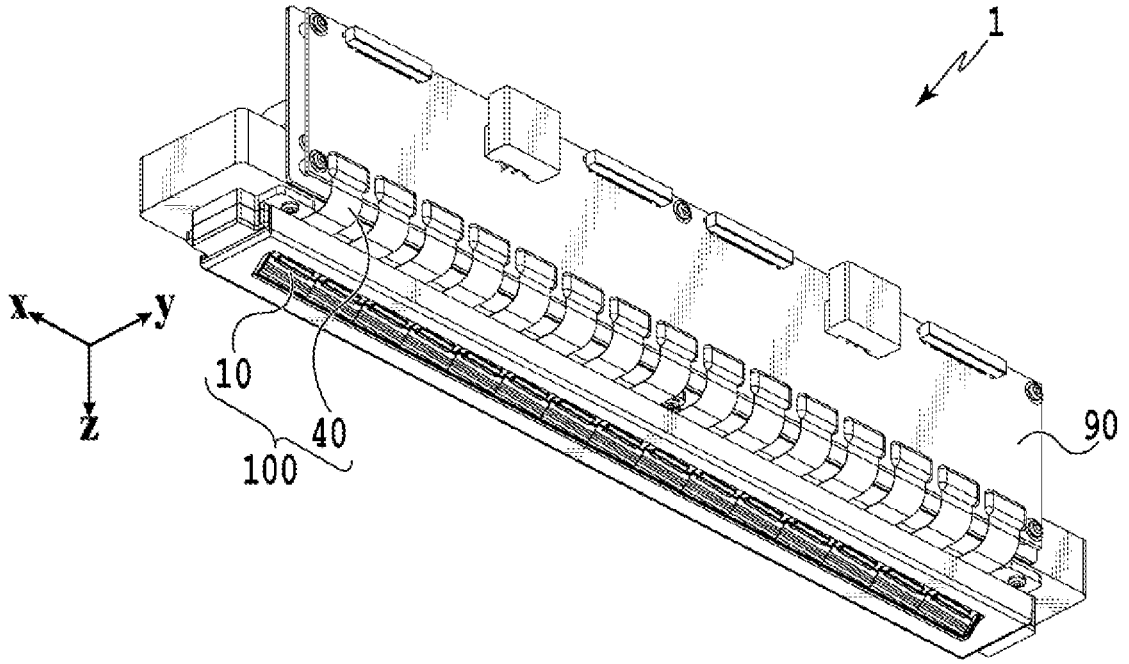
FIG. 1 is a perspective view of a liquid ejection head.

FIG. 1 is a perspective view of a liquid ejection head 1 usable in this embodiment. The liquid ejection head 1 of this embodiment is formed by arranging multiple liquid ejection modules 100 (arraying multiple modules) in an x direction. Each liquid ejection module 100 includes an element board 10 on which ejection elements are arranged, and a flexible wiring board 40 for supplying electric power and ejection signals to the respective ejection elements. The respective flexible wiring boards 40 are connected to an electric wiring board 90 used in common, which is provided with arrays of power supply terminals and ejection signal input terminals. Each liquid ejection module 100 is easily attachable to and detachable from the liquid ejection head 1. Accordingly, any desired liquid ejection module 100 can be easily attached from outside to or detached from the liquid ejection head 1 without having to disassemble the liquid ejection head 1.

Given the liquid ejection head 1 formed by the multiple arrangement of the liquid ejection modules 100 in a longitudinal direction as described above, even if a certain one of the ejection elements causes an ejection failure, only the liquid ejection module involved in the ejection failure needs to be replaced. Thus, it is possible to improve a yield of the liquid ejection heads 1 during a manufacturing process thereof, and to reduce costs for replacing the head.

(Configuration of Liquid Ejection Apparatus)

Figure 2:
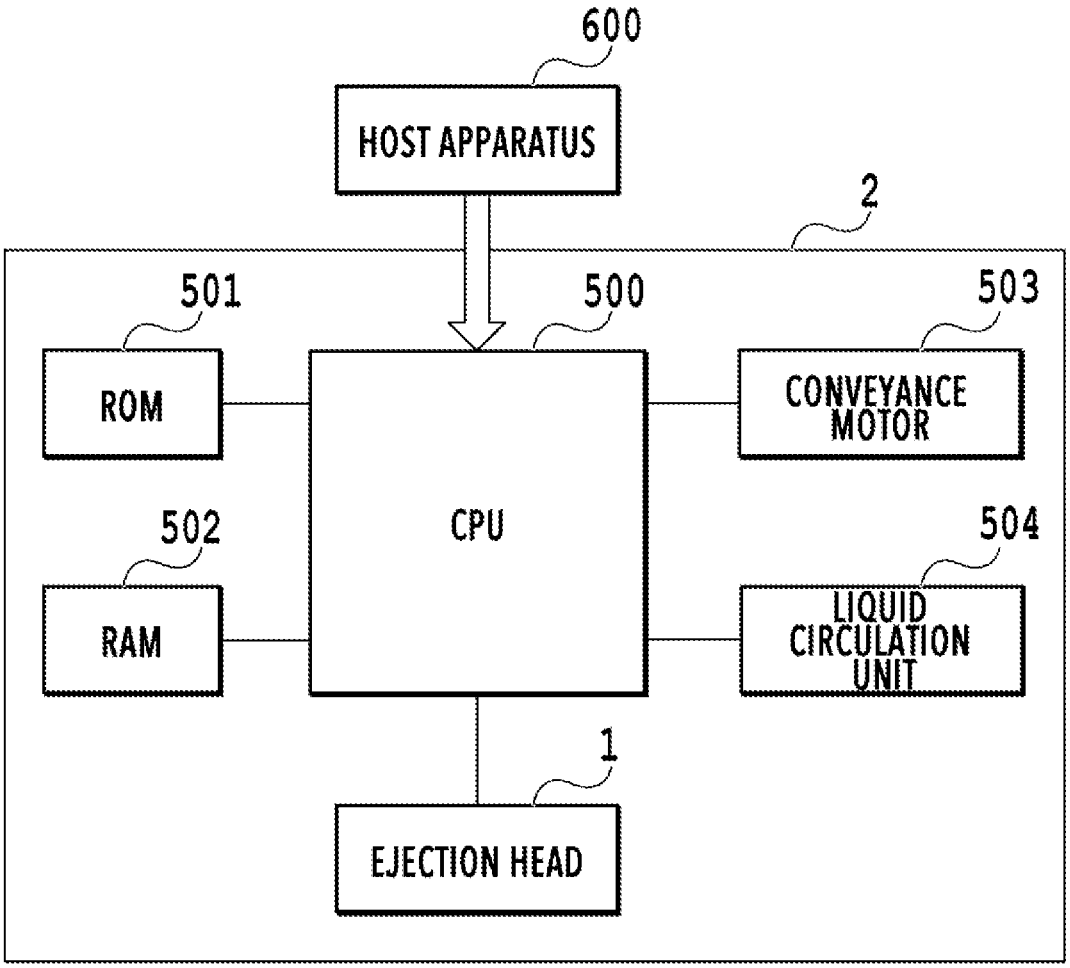
FIG. 2 is a block diagram for explaining a control configuration of a liquid ejection apparatus.

FIG. 2 is a block diagram showing a control configuration of a liquid ejection apparatus 2 usable in this embodiment. A CPU 500 controls the entire liquid ejection apparatus 2 in accordance with programs stored in a ROM 501 while using a RAM 502 as a work area. The CPU 500 performs prescribed data processing in accordance with the programs and parameters stored in the ROM 501 on ejection data to be received from an externally connected host apparatus 600, for example, thereby generating the ejection signals for causing the liquid ejection head 1 to eject a liquid. Then, the liquid ejection head 1 is driven in accordance with the ejection signals while a target medium for depositing the liquid is moved in a predetermined direction by driving a conveyance motor 503. Thus, the liquid ejected from the liquid ejection head 1 is deposited on the deposition target medium for adhesion.

A liquid circulation unit 504 is a unit configured to circulate and supply the liquid to the liquid ejection head 1 and to conduct flow rate control of the liquid in the liquid ejection head 1. The liquid circulation unit 504 includes a sub-tank to store the liquid, a flow passage for circulating the liquid between the sub-tank and the liquid ejection head 1, pumps, a valve mechanism, and so forth. Hence, under the instruction of the CPU 500, the liquid circulation unit 504 controls the pumps and the valve mechanism such that the liquid flows in the liquid ejection head 1 at a predetermined flow rate.

(Configuration of Element Board)

Figure 3:
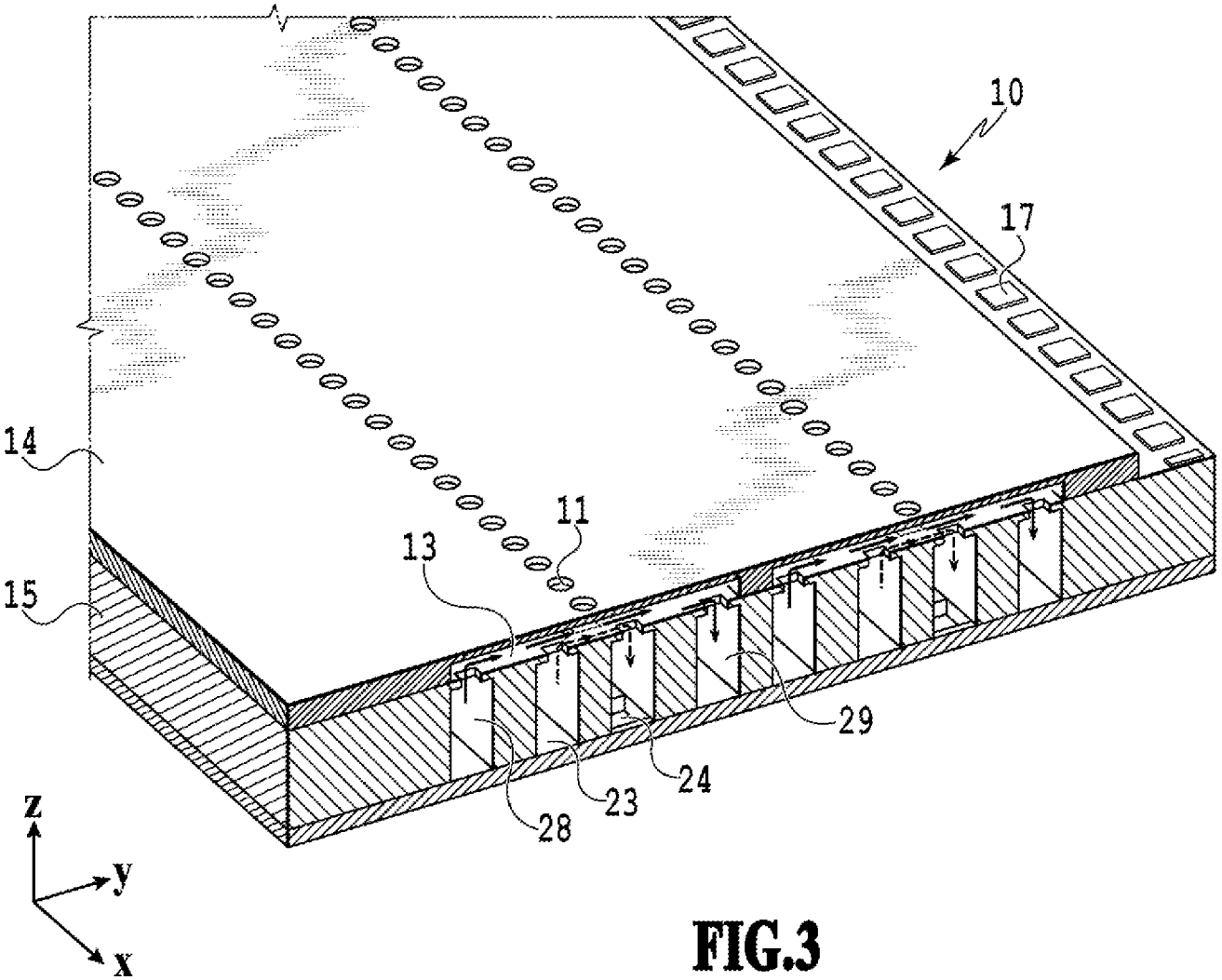
FIG. 3 is a cross-sectional perspective view of an element board in a liquid ejection module.

FIG. 3 is a cross-sectional perspective view of the element board 10 provided in each liquid ejection module 100. The element board 10 is formed by stacking an orifice plate (an ejection port forming member) 14 on a silicon (Si) substrate 15. In the orifice plate 14, multiple ejection ports 11 for ejecting liquid are arranged in the x direction. In FIG. 3, the ejection ports 11 arranged in the x direction eject the liquid of the same type (such as a liquid supplied from a common sub-tank or a common supply port). FIG. 3 illustrates an example in which the orifice plate 14 is also provided with liquid flow passages 13. Instead, the element board 10 may adopt a configuration in which the liquid flow passages 13 are formed by using a different component (a flow passage wall forming member) and the orifice plate 14 provided with the ejection ports 11 is placed thereon.

Pressure generating elements 12 (not shown in FIG. 3 but shown in FIG. 4) are disposed at positions on the substrate 15 corresponding to the respective ejection ports 11. Each ejection port 11 and the corresponding pressure generating element 12 are located at such positions that are opposed to each other. In a case where a voltage is applied to the pressure generating element 12 in response to an ejection signal, the pressure generating element 12 applies a pressure to the liquid in a z direction orthogonal to a flow direction (a y direction) of the liquid. Accordingly, the liquid is ejected in the form of a droplet from the ejection port 11 opposed to the pressure generating element 12. The flexible wiring board 40 supplies the electric power and driving signals to the pressure generating elements 12 via terminals 17 arranged on the substrate 15.

The multiple liquid flow passages 13 which extend in the y direction and are connected to the ejection ports 11, respectively, are formed in the orifice plate 14. Meanwhile, the liquid flow passages 13 arranged in the x direction are connected to a first common supply flow passage 23, a first common collection flow passage 24, a second common supply flow passage 28, and a second common collection flow passage 29 in common. Flows of liquids in the first common supply flow passage 23, the first common collection flow passage 24, the second common supply flow passage 28, and the second common collection flow passage 29 are controlled by the liquid circulation unit 504 described with reference to in FIG. 2. To be more precise, the pump is subjected to such drive control that a first liquid flowing from the first common supply flow passage 23 into the liquid flow passages 13 is directed to the first common collection flow passage 24 while a second liquid flowing from the second common supply flow passage 28 into the liquid flow passages 13 is directed to the second common collection flow passage 29.

FIG. 3 illustrates an example in which the ejection ports 11 and the liquid flow passages 13 arranged in the x direction as described above, and the first and second common supply flow passages 23 and 28 as well as the first and second common collection flow passages 24 and 29 used in common for supplying and collecting inks to and from these ports and passages are defined as a set, and two sets of these constituents are arranged in the y direction.

(Configurations of Liquid Flow Passage and Pressure Chamber)

Figure 4A:
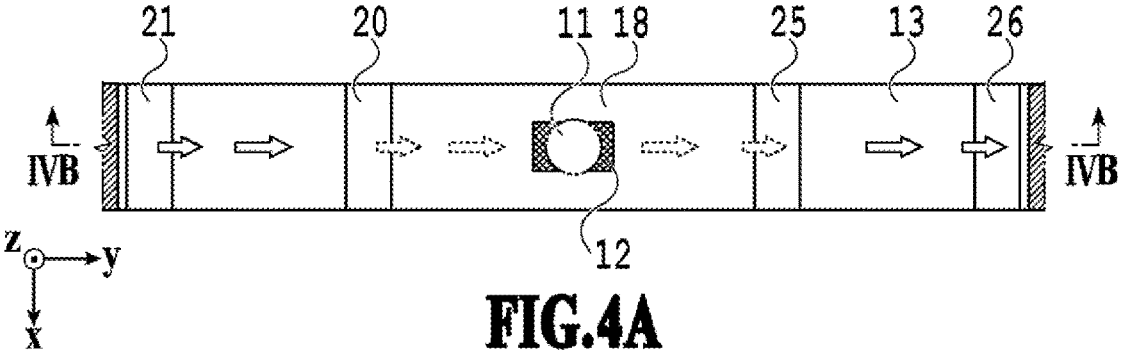
FIGS. 4A to 4C are drawings showing a liquid flow passage formed in the element board and FIG. 4D is an enlarged detail drawing of a pressure chamber.
Figure 4B:
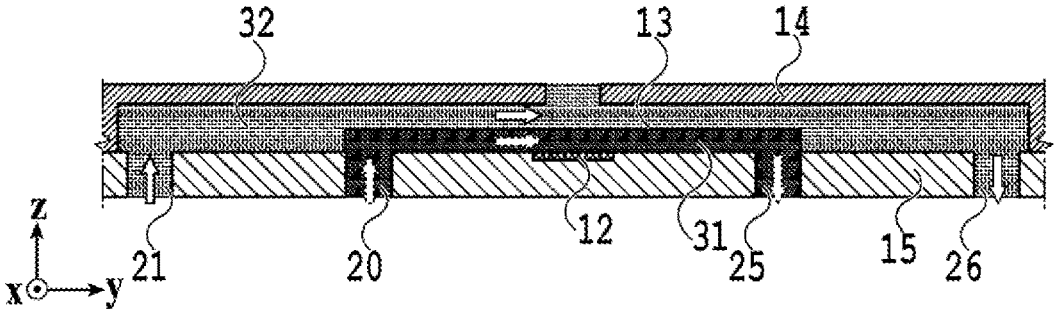
Figure 4C:
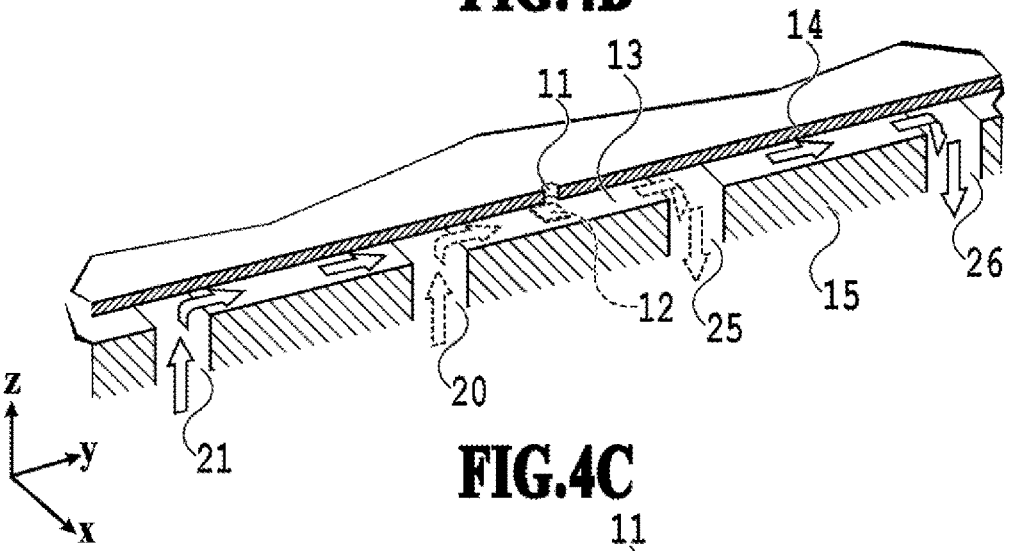

FIGS. 4A to 4D are diagrams for explaining configurations of each liquid flow passage 13 and of each pressure chamber 18 formed in the element board 10 in detail. FIG. 4A is a perspective view from the ejection port 11 side (from a +z direction side) and FIG. 4B is a cross-sectional view taken along the IVB-IVB line in FIG. 4A. Meanwhile, FIG.

Figure 4D:
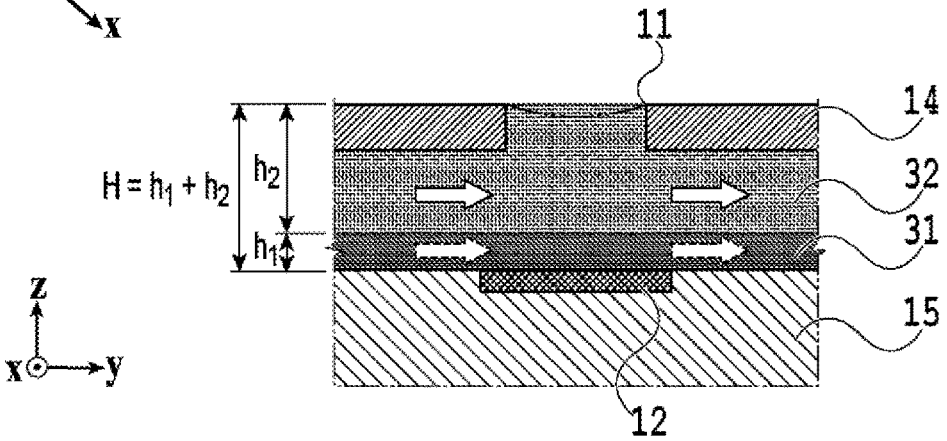

4C is an enlarged diagram of the neighborhood of one of the liquid flow passages 13 in the element board shown in FIG. 3, and FIG. 4D is an enlarged diagram of the neighborhood of the ejection port in FIG. 4B.

The substrate 15 corresponding to a bottom portion of the liquid flow passage 13 includes a second inflow port 21, a first inflow port 20, a first outflow port 25, and a second outflow port 26, which are formed in this order in the y direction. Moreover, the pressure chamber 18 including the ejection port 11 and the pressure generating element 12 is located substantially at the center between the first inflow port 20 and the first outflow port 25 in the liquid flow passage 13. The second inflow port 21 is connected to the second common supply flow passage 28, the first inflow port 20 is connected to the first common supply flow passage 23, the first outflow port 25 is connected to the first common collection flow passage 24, and the second outflow port 26 is connected to the second common collection flow passage 29, respectively (see FIG. 3).

Under the above-described configuration, a first liquid 31 supplied from the first common supply flow passage 23 to the liquid flow passage 13 through the first inflow port 20 flows in the y direction (a direction indicated with arrows), then passes through the pressure chamber 18 and is collected by the first common collection flow passage 24 through the first outflow port 25. Meanwhile, a second liquid 32 supplied from the second common supply flow passage 28 to the liquid flow passage 13 through the second inflow port 21 flows in the y direction (the direction indicated with arrows), then passes through the pressure chamber 18 and is collected by the second common collection flow passage 29 through the second outflow port 26. In other words, both of the first liquid and the second liquid flow in the y direction in a section of the liquid flow passage 13 between the first inflow port 20 and the first outflow port 25. In the pressure chamber 18, the pressure generating element 12 is in contact with the first liquid 31 while the second liquid 32 exposed to the atmosphere forms a meniscus in the vicinity of the ejection port 11. The first liquid 31 and the second liquid 32 flow in the pressure chamber 18 such that the pressure generating element 12, the first liquid 31, the second liquid 32, and the ejection port 11 are arranged in this order. Specifically, assuming that the pressure generating element 12 is located on a lower side and the ejection port 11 is located on an upper side, the second liquid 32 flows above the first liquid 31. Moreover, the first liquid 31 is pressurized by the pressure generating element 12 located below and at least the second liquid 32 is ejected upward from the bottom. Note that this up-down direction corresponds to a height direction of the pressure chamber 18 and of the liquid flow passage 13.

In this embodiment, flow rates of the first liquid 31 and of the second liquid 32 are adjusted in accordance with physical properties of the first liquid 31 and the second liquid 32 such that the first liquid 31 and the second liquid 32 flow in contact with each other in the pressure chamber as shown in FIG. 4D. The flows of the two liquids include not only parallel flows shown in FIG. 4D in which the two liquids flow in the same direction, but also flows of the liquids in which the flow of the first liquid crosses the flow of the second liquid. In the following, the parallel flows out of these flows will be described as an example.

In the case of the parallel flows, it is preferable to keep an interface between the first liquid 31 and the second liquid 32 from being disturbed, or in other words, to establish a state of laminar flows inside the pressure chamber 18 with the flows of the first liquid 31 and the second liquid 32. Specifically, in the case of an attempt to control an ejection performance so as to maintain a predetermined amount of ejection, for instance, it is preferable to drive the pressure generating element in a state where the interface is stable. Nevertheless, this embodiment is not limited only to this configuration. Even if the interface between the two liquids in the pressure chamber 18 gets unstable a little, the pressure generating element 12 may still be driven in a state where at least the first liquid flows mainly on the pressure generating element 12 side and the second liquid flows mainly on the ejection port 11 side. The following description will be mainly focused on the example where the flows in the pressure chamber are in the state of parallel flows and in the state of laminar flows.

(Conditions to Form Parallel Flows in Concurrence with Laminar Flows)

Conditions to form laminar flows of liquids in a tube will be described to begin with. The Reynolds number Re to represent a ratio between viscous force and interfacial tension has been generally known as a flow evaluation index.

Now, a density of a liquid is defined as ρ, a flow velocity thereof is defined as u, a representative length thereof is defined as d, and a viscosity is defined as η. In this case, the Reynolds number Re can be expressed by the following (formula 1):

$$Re=\rho ud/\eta \qquad \text{(formula 1).}$$

Here, it is known that the laminar flows are more likely to be formed as the Reynolds number Re becomes smaller. To be more precise, it is known that flows inside a circular tube are formed into laminar flows in the case where the Reynolds number Re is smaller than some 2200 and the flows inside the circular tube become turbulent flows in the case where the Reynolds number Re is larger than some 2200, for example.

In the case where the flows are formed into the laminar flows, flow lines become parallel to a traveling direction of the flows without crossing each other. Accordingly, in the case where the two liquids in contact constitute the laminar flows, the liquids can form the parallel flows with the stable interface between the two liquids. Here, in view of a general inkjet printing head, a height H [μm] of the flow passage (the height of the pressure chamber) in the vicinity of the ejection port in the liquid flow passage (the pressure chamber) is in a range from about 10 to 100 μm. In this regard, in the case where water (density $\rho=1.0\times10^3$ kg/m$^3$, viscosity $\eta=1.0$ cP) is fed to the liquid flow passage of the inkjet printing head at a flow velocity of 100 mm/s, the Reynolds number Re turns out to be $Re=\rho ud/\eta\approx0.1\sim1.0<<2200$. As a consequence, the laminar flows can be deemed to be formed therein.

Here, even if the liquid flow passage 13 and the pressure chamber 18 have rectangular cross-sections as shown in FIG. 4A, the liquid flow passage 13 and the pressure chamber 18 can be treated like in the case of the circular tube, or more specifically, an effective form of the liquid flow passage 13 or the pressure chamber 18 can be deemed as the diameter of the circular tube.

(Theoretical Conditions to Form Parallel Flows in State of Laminar Flows)

Next, conditions to form the parallel flows with the stable interface between the two types of liquids in the liquid flow passage 13 and the pressure chamber 18 will be described with reference to FIG. 4D. First, a distance from the substrate 15 to an ejection port surface of the orifice plate 14 is defined as H [μm]. Then, a distance between the ejection port surface and a liquid-liquid interface between the first liquid 31 and the second liquid 32 (a phase thickness of the second liquid) is defined as $h_2$ [μm], and a distance between the liquid-liquid interface and the substrate 15 (a phase thickness of the first liquid) is defined as $h_1$ [μm]. In other words, an equation $H=h_1+h_2$ holds true.

Here, as for boundary conditions in the liquid flow passage 13 and the pressure chamber 18, velocities of the liquids on wall surfaces of the liquid flow passage 13 and the pressure chamber 18 are assumed to be zero. Moreover, velocities and shear stresses of the first liquid 31 and the second liquid 32 at the liquid-liquid interface are assumed to have continuity. Based on the assumption, if the first liquid 31 and the second liquid 32 form two-layered and parallel steady flows, then a quartic equation as defined in the following (formula 2) holds true in a section of the parallel flows:

$$(\eta_1-\eta_2)(\eta_1Q_1+\eta_2Q_2)h_1^4+2\eta_1H\{\eta_2(3Q_1+Q_2)-2\eta_1Q_1\}h_1^3+3\eta_1H^2\{2\eta_1Q_1-\eta_2(3Q_1+Q_2)\}h_1^2+4\eta_1Q_1H^3(\eta_2-\eta_1)h_1+\eta_1^2Q_1H^4=0 \quad \text{(formula 2).}$$

In the (formula 2), $\eta_1$ represents the viscosity of the first liquid 31, $\eta_2$ represents the viscosity of the second liquid 32, $Q_1$ represents the flow rate of the first liquid 31, and $Q_2$ represents the flow rate of the second liquid 32, respectively. In other words, the first liquid and the second liquid flow so as to establish a positional relationship in accordance with the flow rates and the viscosities of the respective liquids within such ranges to satisfy the above-mentioned quartic equation (formula 2), thereby forming the parallel flows with the stable interface. In this embodiment, it is preferable to form the parallel flows of the first liquid and the second liquid in the liquid flow passage 13 or at least in the pressure chamber 18. In the case where the parallel flows are formed as mentioned above, the first liquid and the second liquid are only involved in mixture due to molecular diffusion on the liquid-liquid interface therebetween, and the liquids flow in parallel in the y direction virtually without causing any mixture. Note that the flows of the liquids do not always have to establish the state of laminar flows in a certain region in the pressure chamber 18. In this context, at least the flows of the liquids in a region above the pressure generating element preferably establish the state of laminar flows.

Even in the case of using immiscible solvents such as oil and water as the first liquid and the second liquid, for example, the stable parallel flows are formed regardless of the immiscibility as long as the (formula 2) is satisfied. Meanwhile, even in the case of oil and water, if the interface is disturbed due to a state of slight turbulence of the flows in the pressure chamber, it is preferable that at least the first liquid flows mainly above the pressure generating element and the second liquid flows mainly in the ejection port.

Figure 5A:
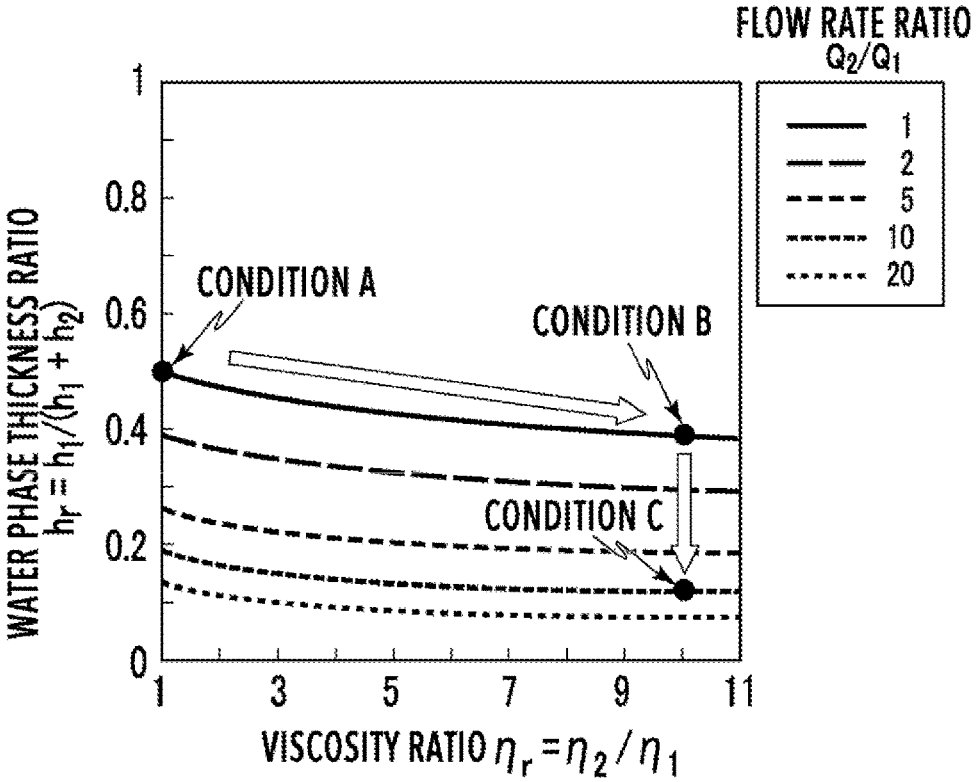
FIG. 5A is a graph showing a relation between a viscosity ratio and a water phase thickness ratio.

FIG. 5A is a graph representing a relation between a viscosity ratio $\eta_r=\eta_2/\eta_1$ and a phase thickness ratio $h_r=h_1/(h_1+h_2)$ of the first liquid while changing a flow rate ratio $Q_r=Q_2/Q_1$ to several levels based on the (formula 2). Although the first liquid is not limited to water, the "phase thickness ratio of the first liquid" will be hereinafter referred to as a "water phase thickness ratio". The horizontal axis indicates the viscosity ratio $\eta_r=\eta_2/\eta_1$ and the vertical axis indicates the water phase thickness ratio $h_r=h_1/(h_1+h_2)$, respectively. The water phase thickness ratio $h_r$ becomes lower as the flow rate ratio $Q_r$ grows higher. Meanwhile, at each level of the flow rate ratio $Q_r$, the water phase thickness ratio $h_r$ becomes lower as the viscosity ratio $\eta_r$ grows higher. Therefore, the water phase thickness ratio $h_r$ (corresponding to the position of the interface between the first liquid and the second liquid) in the liquid flow passage 13 (the pressure chamber) can be adjusted to a desired value by controlling the viscosity ratio $\eta_r$ and the flow rate ratio $Q_r$ between the first liquid and the second liquid. In addition, in the case where the viscosity ratio $\eta_r$ is compared with the flow rate ratio $Q_r$, FIG. 5A teaches that the flow rate ratio $Q_r$ has a larger impact on the water phase thickness ratio $h_r$ than the viscosity ratio $\eta_r$ does.

Here, as for the water phase thickness ratio $h_r=h_1/(h_1+h_2)$, the parallel flows of the first liquid and the second liquid are presumably formed in the liquid flow passage (the pressure chamber) as long as $0<h_r<1$ (condition 1) is satisfied. However, as described later, the first liquid is caused to function mainly as the bubbling medium while the second liquid is caused to function mainly as the ejection medium so as to stabilize a ratio between the first liquid end and the second liquid contained in ejected droplets to a desired value. In consideration of this situation, the water phase thickness ratio $h_r$ is preferably set equal to or below 0.8 (condition 2) or more preferably set equal to or below 0.5 (condition 3).

Note that status A, status B, and status C shown in FIG. 5A represent the following statuses:

Status A) the water phase thickness ratio $h_r=0.50$ in a case where the viscosity ratio $\eta_r=1$ and the flow rate ratio $Q_r=1$;

Status B) the water phase thickness ratio $h_r=0.39$ in a case where the viscosity ratio $\eta_r=10$ and the flow rate ratio $Q_r=1$; and Status C) the water phase thickness ratio $h_r=0.12$ in a case where the viscosity ratio $\eta_r=10$ and the flow rate ratio $Q_r=10$.

Figure 5B:
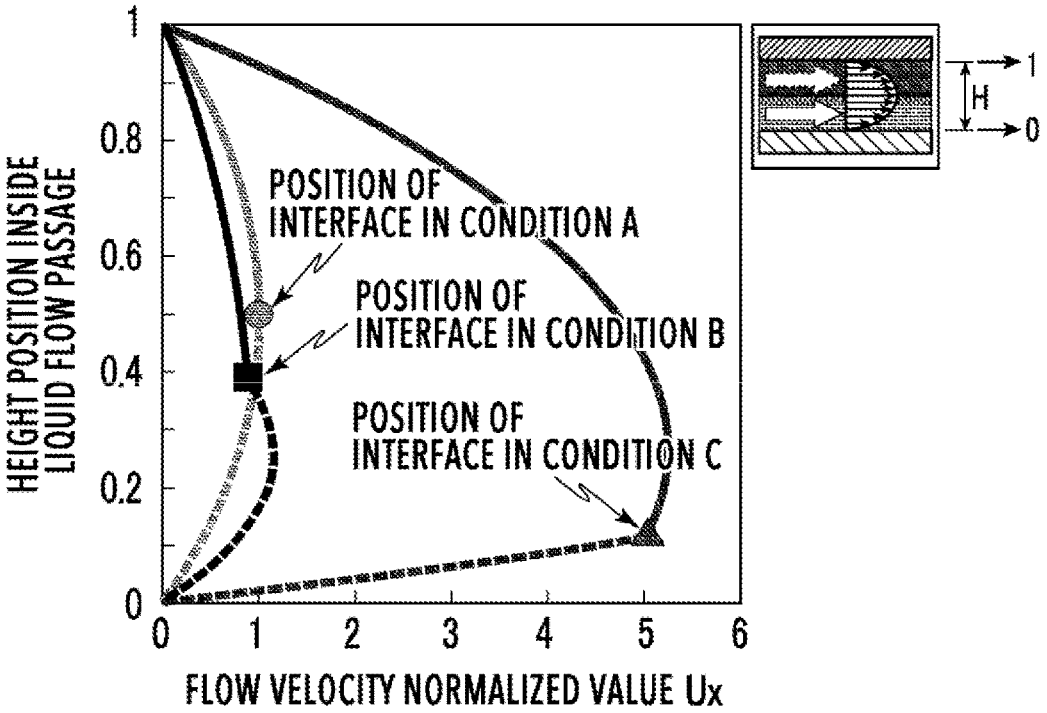
FIG. 5B is a graph showing a relation between a height of the pressure chamber and a flow velocity.

FIG. 5B is a graph showing flow velocity distribution in the height direction (the z direction) of the liquid flow passage 13 (the pressure chamber) regarding the above-mentioned statuses A, B, and C, respectively. The horizontal axis indicates a normalized value Ux which is normalized by defining the maximum flow velocity value in the status A as 1 (a criterion). The vertical axis indicates the height from a bottom surface in the case where the height H of the liquid flow passage 13 (the pressure chamber) is defined as 1 (a criterion). On each of curves indicating the respective statuses, the position of the interface between the first liquid and the second liquid is indicated with a marker. FIG. 5B shows that the position of the interface varies depending on the statuses such as the position of the interface in the status A being located higher than the positions of the interface in the status B and the status C. The reason for this phenomenon is that, in the case where the two types of liquids having different viscosities from each other flow in parallel in the tube while forming the laminar flows, respectively (and forming laminar flows as a whole), the interface between those two liquids is formed at a position where a difference in pressure attributed to the difference in viscosity between the liquids balances a Laplace pressure attributed to the interfacial tension.

(Flows at Liquid-Liquid Interface During Ejection)

As the first liquid and the second liquid flow severally, a liquid level (the liquid-liquid interface) is formed at a position corresponding to the viscosity ratio $\eta_r$ and the flow rate ratio $Q_r$ therebetween (corresponding to the water phase thickness ratio $h_r$). If the liquids are successfully ejected from the ejection port 11 while maintaining the position of the interface, then it is possible to achieve a stable ejection operation. The following are two possible configurations for achieving the stable ejection operation:

Configuration 1: a configuration to eject the liquids in a state where the first liquid and the second liquid are flowing; and Configuration 2: a configuration to eject the liquids in a state where the first liquid and the second liquid are at rest.

The configuration 1 makes it possible to eject the liquids stably while maintaining the given position of the interface. This is due to a reason that an ejection velocity (several meters per second to more than ten meters per second) of a droplet in general is faster than flow velocities (several millimeters per second to several meters per second) of the first liquid and the second liquid, and the ejection of the liquids is affected little even if the first liquid and the second liquid are kept flowing during the ejection operation.

In the meantime, the status 2 also makes it possible to eject the liquids stably while maintaining the given position of the interface. This is due to a reason that the first liquid and the second liquid are not mixed immediately due to a diffusion effect on the liquids on the interface, and an unmixed state of the liquids is maintained for a very short period of time. During a period of several tens of microseconds at a general inkjet driving frequency in a case where a low-molecular material in water has a typical diffusion coefficient of $D=10^{-9}$ $m^2/s$, the liquids are diffused in a distance of only 0.2 to 0.3 μm. Accordingly, the interface is maintained in the state where the flows of the liquids are stopped to rest immediately before ejecting the liquids. Thus, it is possible to eject the liquid while maintaining the position of the interface therebetween.

However, the configuration 1 is preferable because this configuration can reduce adverse effects of mixture of the first and second liquids due to the diffusion of the liquids on the interface and because it is not necessary to conduct advanced control for flowing and stopping the liquids.

(Ejection Modes of Liquids)

A percentage of the first liquid contained in droplets ejected from the ejection port (ejected droplets) can be changed by adjusting the position of the interface (corresponding to the water phase thickness ratio $h_r$). Such ejection modes of the liquids can be broadly categorized into two modes depending on types of the ejected droplets:

Mode 1: a mode of ejecting only the second liquid; and

Mode 2: a mode of ejecting the second liquid inclusive of the first liquid.

The mode 1 is effective, for example, in a case of using a liquid ejection head of a thermal type that employs an electrothermal converter (a heater) as the pressure generating element 12, or in other words, in a case of using a liquid ejection head that utilizes a bubbling phenomenon that depends heavily on properties of a liquid. This liquid ejection head is prone to destabilize bubbling of the liquid due to a scorched portion of the liquid developed on a surface of the heater. The liquid ejection head also has a difficulty in ejecting some types of liquids such as non-aqueous inks. However, if a bubbling agent that is suitable for bubble generation and is less likely to develop scorch on the surface of the heater is used as the first liquid and any of functional agents having a variety of functions is used as the second liquid by adopting the mode 1, it is possible to eject the liquid such as a non-aqueous ink while suppressing the development of the scorch on the surface of the heater.

The mode 2 is effective for ejecting a liquid such as a high solid content ink not only in the case of using the liquid ejection head of the thermal type but also in a case of using a liquid ejection head that employs a piezoelectric element as the pressure generating element 12. To be more precise, the mode 2 is effective in the case of ejecting a high-density pigment ink having a large content of a pigment being a coloring material onto a printing medium. In general, by increasing the density of the pigment in the pigment ink, it is possible to improve chromogenic properties of an image printed on a printing medium such as plain paper by use of the high-density pigment ink. Moreover, by adding a resin emulsion (resin EM) to the high-density pigment ink, it is possible to improve abrasion resistance and the like of a printed image owing to the resin EM formed into a film. However, an increase in solid component such as the pigment and the resin EM tends to develop agglomeration at a close interparticle distance, thus causing deterioration in dispersibility. Accordingly, it is difficult to disperse each of the pigment and the resin EM into the ink at a high density. The pigment is especially harder to disperse than the resin EM. For this reason, the pigment and the resin EM have heretofore been dispersed by reducing the amount of one of them. To be more precise, the pigment and the resin EM have been dispersed by setting ratios of the pigment and the resin EM contained in the ink, for example, to 4 wt % and 15 wt % or to 8 wt % and 4 wt %, respectively.

However, by adopting the above-described mode 2, it is possible to use the high-density resin EM ink as the first liquid and to use the high-density pigment ink as the second liquid. In this way, each of the pigment ink and the resin EM ink can be ejected at a high density. As a consequence, it is possible to deposit the high-density pigment ink and the high-density resin EM ink on the printing medium, thereby printing a high-quality image that can be hardly achievable with a single ink, or in other words, an image with good chromogenic properties, excellent abrasion resistance, and the like. Specifically, the use of the mode 2 makes it possible to deposit the high-density pigment at a density in a range from 8 to 12 wt % and the high-density resin EM at a density in a range from 15 to 20 wt %, for example, on the printing medium, respectively.

(Configuration of Confluence Unit on Inflow Side)

Figure 6A:
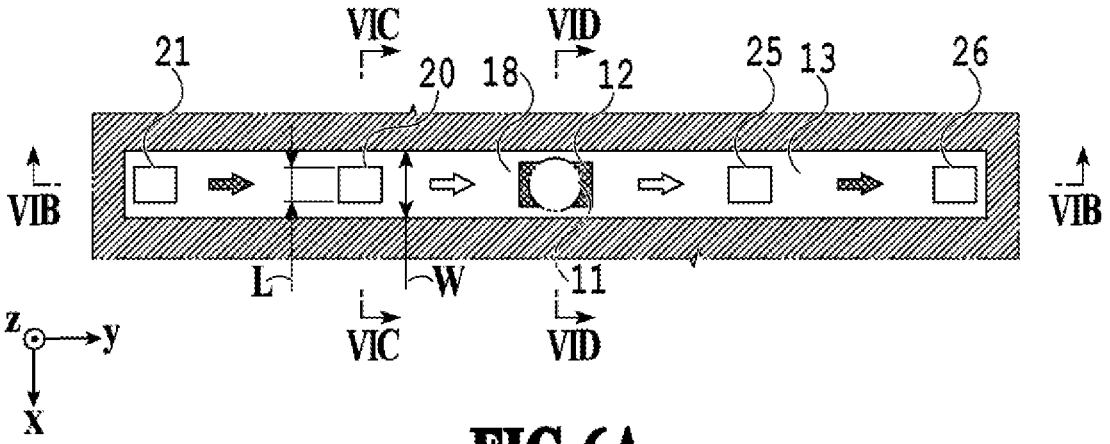
FIGS. 6A to 6D are drawings showing a liquid flow passage and a pressure chamber formed in an element board of a comparative example.
Figure 6B:
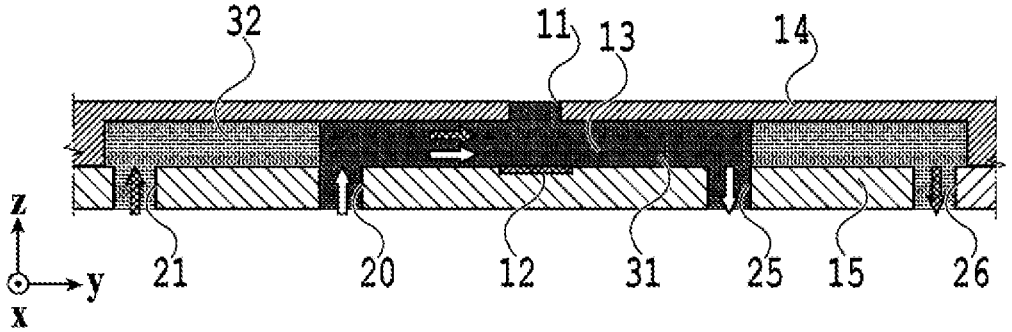
Figure 6C:
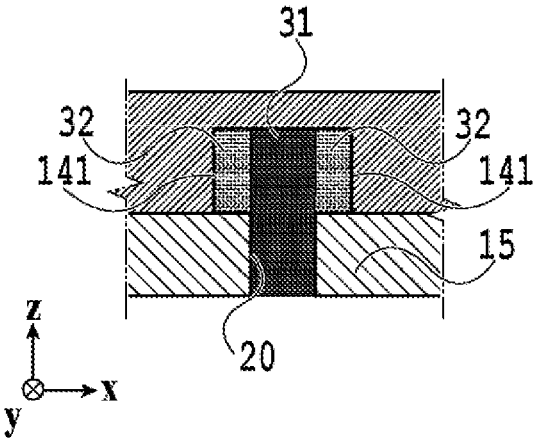
Figure 6D:
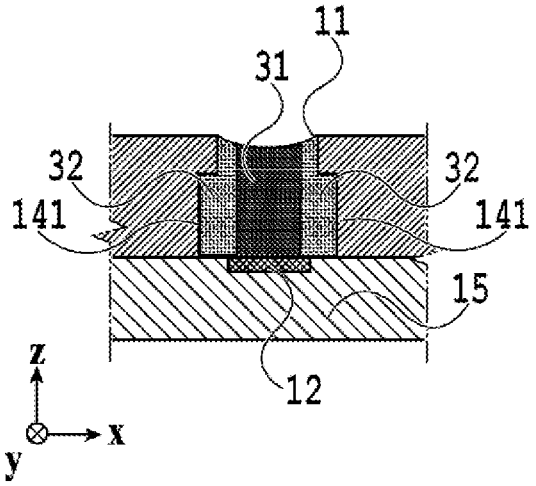

FIGS. 6A to 6D are diagrams showing one liquid flow passage 13 and one pressure chamber 18 formed in the element board 10. FIGS. 6A to 6D represent a comparative example in which the liquid-liquid interface is formed such that the first liquid and the second liquid are arranged in the x direction in the pressure chamber 18. FIG. 6A is a perspective view from the ejection port 11 side (from the +z direction side) and FIGS. 6B to 6D are cross-sectional views taken along the VIB-VIB line, the VIC-VIC line, and the VID-VID line in FIG. 6A, respectively.

A length of the first inflow port 20 in a direction (hereinafter referred to as a width direction) orthogonal to a direction of flow of the liquids in the pressure chamber 18 (a direction of arrows in FIG. 6A) and to a direction from the pressure generating element 12 to the ejection port 11 (a height direction) will be defined as L. Meanwhile, a length in the width direction of the liquid flow passage 13 will be defined as W. As shown in FIG. 6A, the length L of the first inflow port 20 is shorter than the length W of the liquid flow passage 13 and a relation of L<W holds true (see FIG. 6A). In the case of this configuration, as shown in FIG. 6C, the first liquid 31 flows from the first inflow port 20 into a central region in the width direction of the liquid flow passage 13 while the second liquid 32 flows along wall surfaces 141 constituting the liquid flow passage 13, which are located on the right and left in the direction of flow of the liquids in the liquid flow passage 13.

Figure 7A:
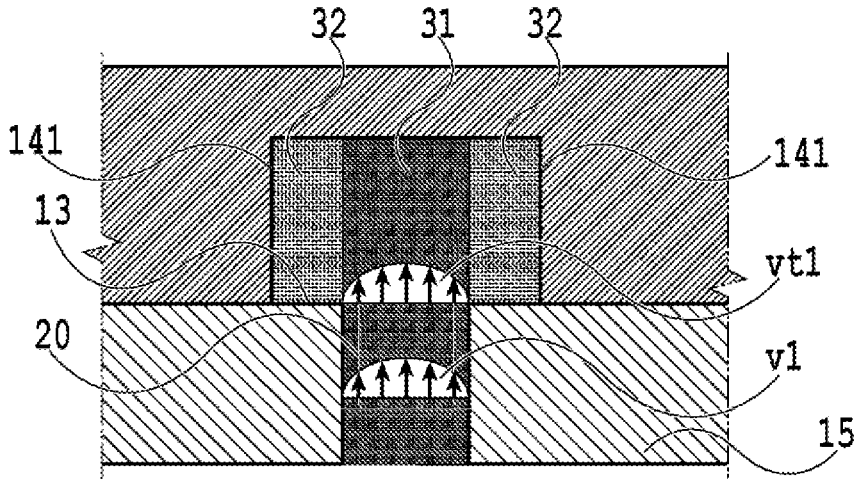
FIGS. 7A and 7B are explanatory diagrams of a first inflow port of the comparative example.

FIG. 7A is a diagram which shows vectors of velocity distribution of the first liquid 31 in the same cross-sectional view as FIG. 6C. At the first inflow port 20, velocity distribution v1 of the first liquid 31 has such distribution that the velocity of the liquid is zero at a wall surface of the first inflow port 20 and is maximal at the central part of the first inflow port 20. The velocity distribution v1 of the first liquid 31 in the z direction turns into velocity distribution vt1 after the first liquid 31 is discharged from the first inflow port 20.

Figure 7B:
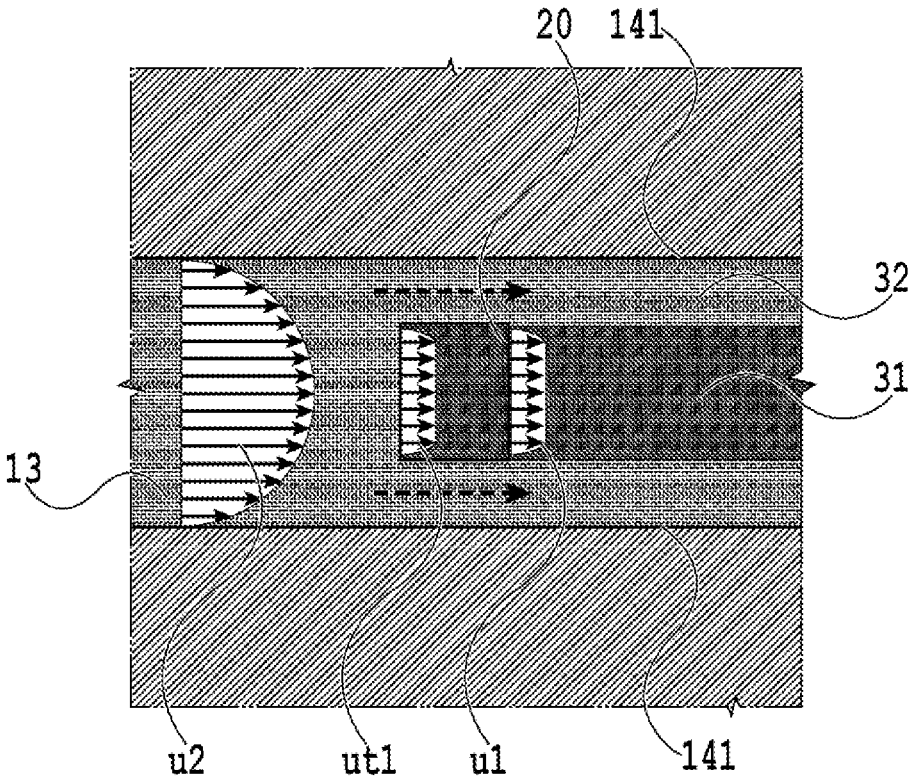

FIG. 7B is an enlarged diagram in the vicinity of the first inflow port 20 of FIG. 6A, which is a diagram showing vectors of velocity distribution of the first liquid 31 and of velocity distribution of the second liquid 32 in the liquid flow passage 13. The velocity distribution vt1 of the first liquid 31 discharged from the first inflow port 20 turns into velocity distribution ut1 in the liquid flow passage 13, and the first liquid 31 having been subjected to the change into the velocity distribution ut1 flows in the liquid flow passage 13. As described above, the velocity distribution of the first liquid 31 is changed at a bent portion where the first inflow port 20 is coupled to the liquid flow passage 13.

In the meantime, the second liquid 32 is in a state of velocity distribution u2 on an upstream side of the first inflow port 20 in the liquid flow passage 13 in the direction of flow of the liquids. The second liquid 32 having the velocity distribution u2 joins the first liquid 31 having velocity distribution u1. The first liquid 31 in the liquid flow passage 13 is less likely to flow between each wall surface 141 of the liquid flow passage 13 and the first inflow port 20. Hence, the second liquid 32 flows between each wall surface 141 and the first inflow port 20. For this reason, the second liquid 32 flows in such a way as to sandwich the first liquid 31. Accordingly, it is more likely that the liquid-liquid interface is formed in such a way as to arrange the first liquid 31 and the second liquid 32 in the horizontal direction (the width direction) in the liquid flow passage 13.

The second liquid 32 and the first liquid 31 flow to the pressure chamber 18 while maintaining the state in which the liquid-liquid interface is formed in such a way as to arrange the first liquid 31 and the second liquid 32 in the horizontal direction (the width direction) of the liquid flow passage 13. In other words, the first liquid 31 and the second liquid 32 do not form parallel flows that are stacked in the height direction of the liquid flow passage 13.

In the case where the liquid-liquid interface is formed as shown in FIG. 6C, the first liquid 31 flows above the pressure generating element 12 in the pressure chamber 18 in such a way as to substantially occupy an area from the pressure generating element 12 to the ejection port 11 as shown in FIG. 6D. In this way, the liquid to be ejected is substantially composed of the first liquid 31 and it is therefore difficult to principally eject the second liquid 32 that is necessary to achieve the printing.

Figure 8A:
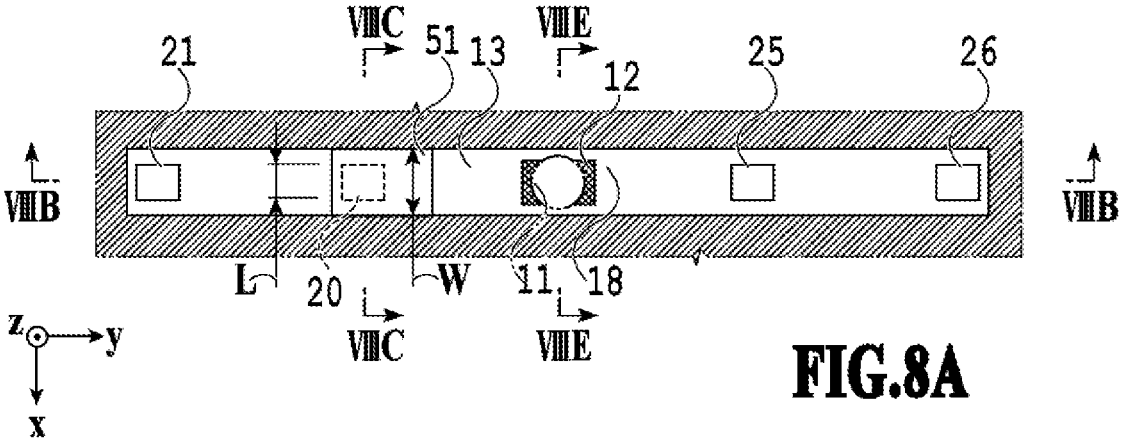
FIGS. 8A to 8D are drawings showing the liquid flow passage for explaining a lateral wall.
Figure 8B:
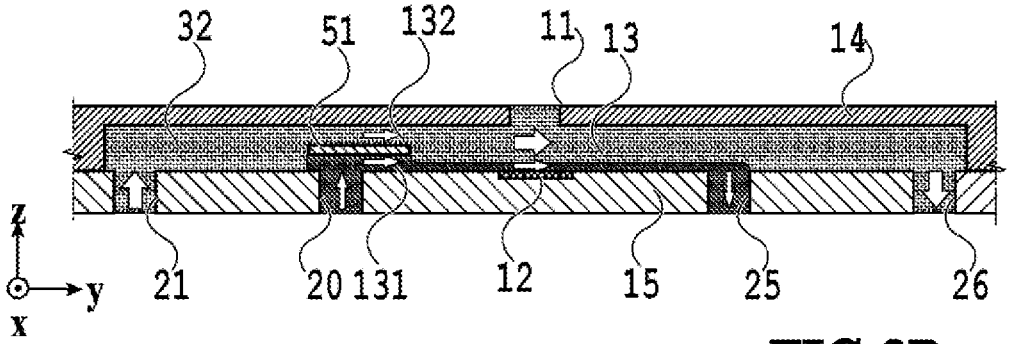

FIGS. 8A to 8E are diagrams for explaining the one liquid flow passage 13 and the one pressure chamber 18 formed in the element board 10 of this embodiment. FIG. 8A is a perspective view from the ejection port 11 side (from the +z direction side) and FIG. 8B is a cross-sectional view taken along the VIIIB-VIIIB line in FIG. 8A. As with FIGS. 6A and 6B, FIGS. 8A and 8B show a configuration in which the dimension L in the width direction of the first inflow port 20 is shorter than the length W in the width direction of the liquid flow passage 13 (L<W).

In this embodiment, a lateral wall (a wall) 51 is provided in such a way as to be opposed to the first inflow port 20. A length in the width direction of the lateral wall 51 of this embodiment is equal to the length W in the width direction of the liquid flow passage. The equality mentioned here does not always have to be strictly equal. The lengths may be deemed equal as long as the lengths are substantially the same after taking into account a manufacturing error and other allowable differences. The lateral wall 51 extends in a direction of extension of the liquid flow passage and at least part of the lateral wall is located above the first inflow port. A basic function of the lateral wall 51 is to separate the flows of the liquids in the liquid flow passage 13 into a flow that flows on an upper flow passage 132 out of the flow passage between the lateral wall 51 and the orifice plate 14 and into a flow that flows on a lower flow passage 131 out of the flow passage between the lateral wall 51 and the substrate 15. The liquids flowing on the upper flow passage 132 and the lower flow passage 131 join together at an end portion on a downstream side of the lateral wall 51 in the direction of flow of the liquids. The liquids flowing on the upper flow passage 132 and the lower flow passage 131 form parallel flows stacked in the height direction of the liquid flow passage 13 thanks to the presence of the lateral wall 51. For this reason, even in the case where the first liquid 31 and the second liquid 32 join together at the end portion of on the downstream side of the lateral wall 51 in the direction of flow of the liquids, the liquid-liquid interface is stably formed such that the first liquid 31 and the second liquid 32 are arranged in the height direction of the liquid flow passage 13 (the vertical direction). As a consequence, the first liquid 31 and the second liquid 32 can also flow in the pressure chamber 18 while maintaining the interface as shown in FIG. 4D.

(Concerning Liquids Flowing on Upper Flow Passage and Lower Flow Passage)

Figure 8C:
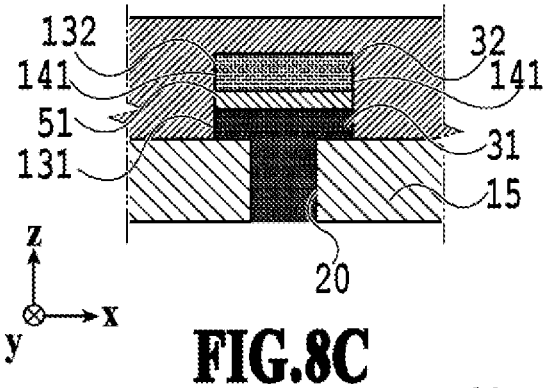

Now, some examples of this embodiment will be described involving various states of the liquids flowing on the upper flow passage 132 and the lower flow passage 131. FIG. 8C is a cross-sectional view taken along the VIIIC-VIIIC line in FIG. 8A. A description will be given below of an example in which only the first liquid 31 flows on the lower flow passage 131 and only the second liquid 32 flows on the upper flow passage 132 as shown in FIG. 8C.

Figure 8D:
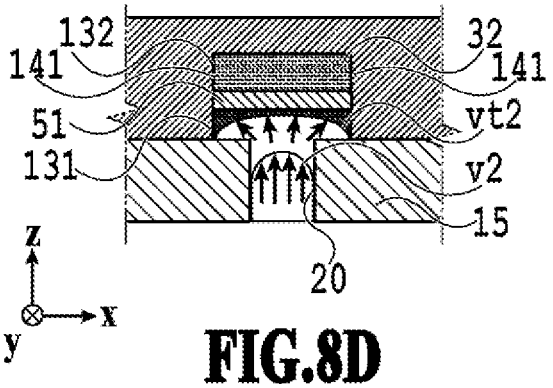

FIG. 8D is a diagram which shows vectors of velocity distribution of the first liquid 31 in the same cross-sectional view as FIG. 8C. Velocity distribution v2 of the first liquid 31 has such distribution that the velocity of the liquid is zero at the wall surface of the first inflow port 20 and is maximal at the central part thereof. In the case where the first liquid 31 having the flow with the velocity distribution v2 is discharged from the first inflow port 20 and flows toward the lateral wall 51, the velocity distribution of the first liquid 31 turns into velocity distribution vt2. The velocity distribution vt2 of the first liquid 31 in the liquid flow passage 13 of this embodiment has such distribution that the flow spreads in a direction toward the wall surfaces 141 of the liquid flow passage 13 due to an effect of the lateral wall 51.

Accordingly, a flow of the first liquid 31 can also be created in a region between the first inflow port 20 and each wall surface 141 of the liquid flow passage 13 by adjusting the flow rate of the first liquid 31 or the second liquid 32. In other words, in this embodiment, it is possible to fill the lower flow passage 131 with the first liquid 31 by adjusting the flow rate of the first liquid 31. As a consequence, the second liquid 32 is more likely to flow on the upper flow passage 132. In this case, the first liquid 31 flows along the lower flow passage 131 while the second liquid 32 flows along the upper flow passage 132, and the first liquid 31 and the second liquid 32 join together at the end portion on the downstream side of the lateral wall 51.

Figure 8E:
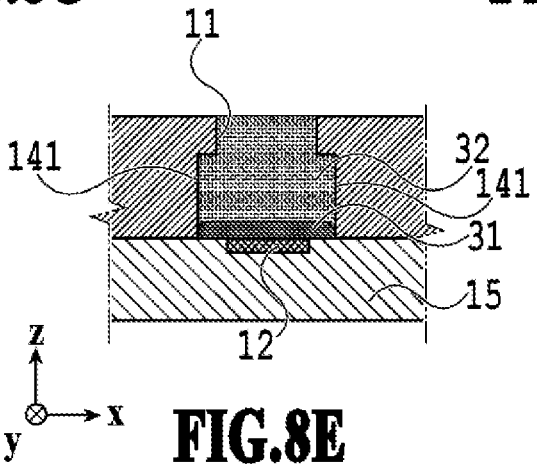
FIG. 8E is a drawing showing the pressure chamber.

FIG. 8E is a cross-sectional view taken along the VIIIE-VIIIE line in FIG. 8A. The first liquid 31 and the second liquid 32 that join together at the end portion on the downstream side of the lateral wall 51 form such a liquid-liquid interface that these liquids are arranged in the z direction in the liquid flow passage 13. The first liquid 31 and the second liquid 32 flow to the pressure chamber 18 while maintaining this liquid-liquid interface. For this reason, the liquid with which the pressure generating element 12 comes into contact for ejection is the first liquid 31 while the second liquid 32 flows on the ejection port 11 side. Hence, it is possible to stably eject the second liquid 32.

Figure 9A:
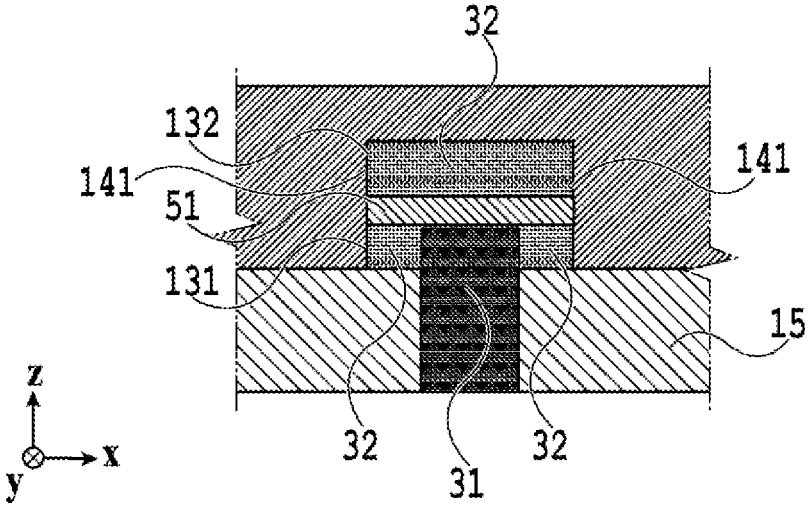
FIG. 9A is a cross-sectional view showing the liquid flow passage for explaining the lateral wall.

Next, a description will be given of two more examples in which only the second liquid 32 flows on the upper flow passage 132 whereas the second liquid 32 as well as the first liquid 31 flow on the lower flow passage 131 because of a low flow rate of the first liquid 31 or a high flow rate of the second liquid 32. FIG. 9A is a cross-sectional view of one of these examples corresponding to the cross-sectional view of FIG. 8C. While the first liquid 31 discharged from the first inflow port 20 flows toward the lateral wall 51, this example represents a case where the first liquid 31 does not fully spread in the direction toward the wall surface 141 of the liquid flow passage 13. For this reason, a region where the first liquid 31 is less likely to flow is created between the first inflow port 20 and each wall surface 141. As a consequence, the second liquid 32 is more likely to flow between the first inflow port 20 and each wall surface 141 of the liquid flow passage 13. Accordingly, the second liquid 32 flows in the lower flow passage 131 in such a way as to sandwich the first liquid 31 in the width direction, whereby three layers of flows are formed in the width direction (the x direction) of the liquid flow passage 13. The three layers of flows join the second liquid 32 flowing on the upper flow passage 132 at the end portion on the downstream side of the lateral wall 51. In the liquid flow passage 13 after this confluence, the second liquid 32 flows in such a way as to surround the first liquid 31. The first liquid 31 and the second liquid 32 flow to the pressure chamber 18 while maintaining this state.

Figure 9B:
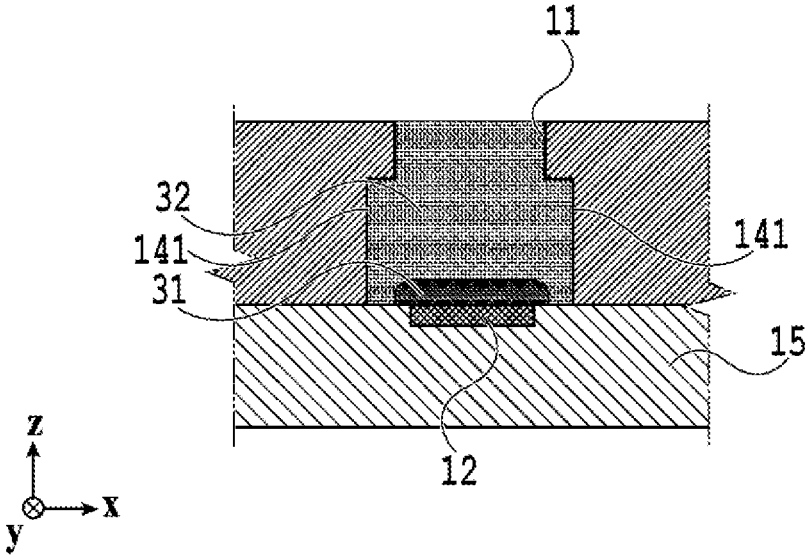
FIG. 9B is a cross-sectional view showing the pressure chamber.

FIG. 9B is a cross-sectional view of this example corresponding to the cross-sectional view of FIG. 8E. The liquid-liquid interface is formed in the pressure chamber 18 such that the second liquid 32 surrounds the first liquid 31. In this state of the liquid-liquid interface, the liquid with which the pressure generating element 12 comes into contact for ejection is mainly the first liquid 31 while the second liquid 32 is located on the ejection port 11 side. Hence, it is possible to stably eject the second liquid 32 in this example as well.

Figure 10A:
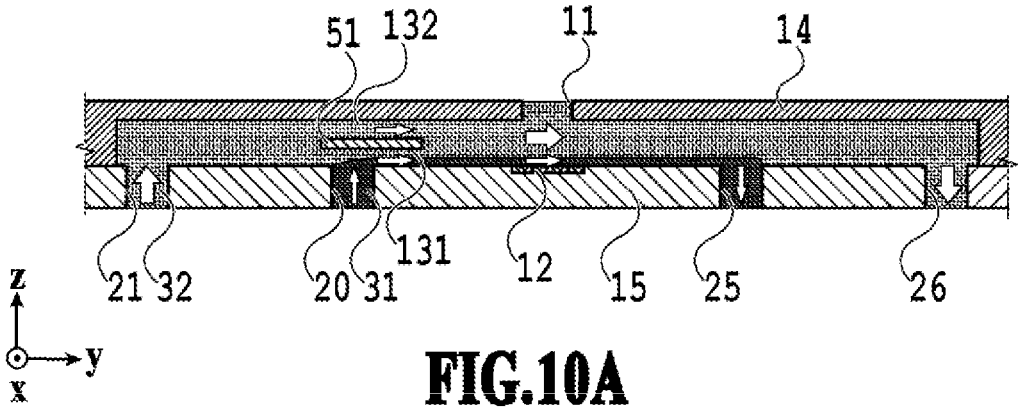
FIGS. 10A and 10B are drawings showing the liquid flow passage for explaining the lateral wall.
Figure 10B:
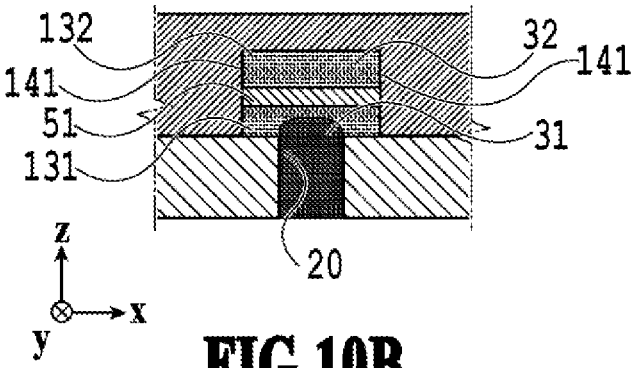
Figure 10C:
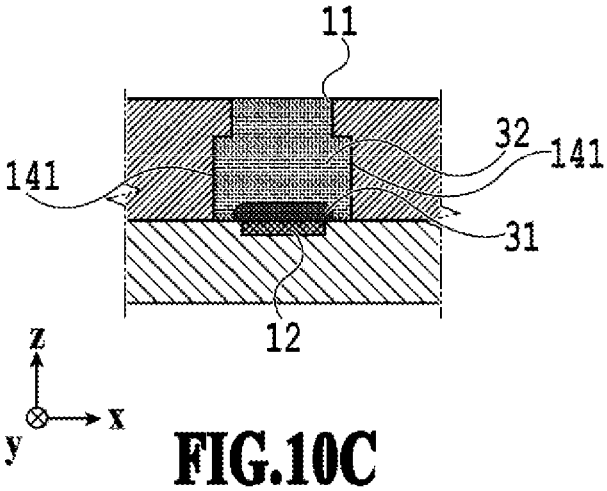
FIG. 10C is a drawing showing the pressure chamber.

FIGS. 10A to 10C are drawings for explaining the other example in which the second liquid 32 as well as the first liquid 31 flow on the lower flow passage 131. FIG. 10A is a cross-sectional view of this example corresponding to the cross-sectional view of FIG. 8B. Meanwhile, FIG. 10B is a cross-sectional view of this example corresponding to the cross-sectional view of FIG. 8C. In this example, the second liquid 32 has a flow rate which is so high that the second liquid 32 flows at a flow rate higher than a maximum allowable flow rate of the upper flow passage 132. Due to this effect, the flow of the second liquid 32 is generated between the first liquid 31 and the lateral wall 51 in the lower flow passage 131. The liquids flowing on the lower flow passage 131 join the second liquid 32 flowing on the upper flow passage 132 at the end portion on the downstream side of the lateral wall 51 while maintaining the shape of this liquid-liquid interface.

FIG. 10C is a cross-sectional view of this example corresponding to the cross-sectional view of FIG. 8E. The liquid-liquid interface is formed in the pressure chamber 18 such that the second liquid 32 surrounds the first liquid 31. Accordingly, the first liquid 31 mainly comes into contact with the pressure generating element 12 and the second liquid 32 is present in the vicinity of the ejection port 11. As a consequence, it is possible to stably generate a bubble of the first liquid 31 with the pressure generating element 12 and to eject the second liquid 32 in this example as well.

Figure 11A:
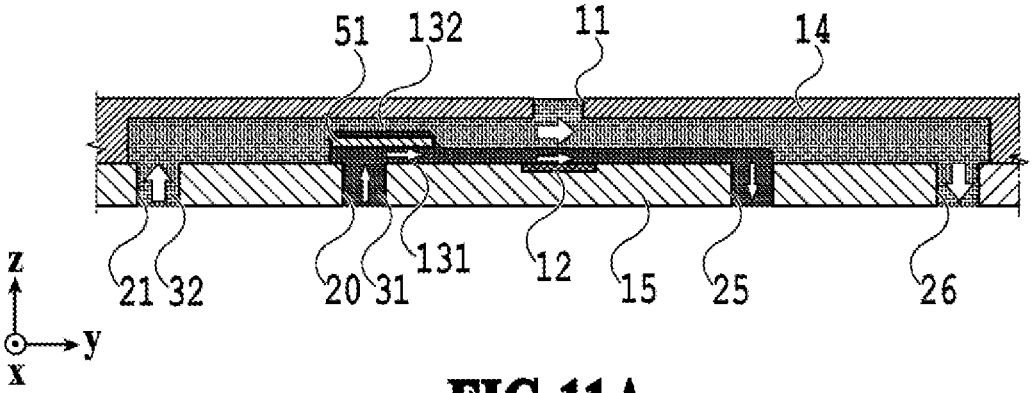
FIGS. 11A and 11B are drawings showing the liquid flow passage for explaining the lateral wall.
Figure 11B:
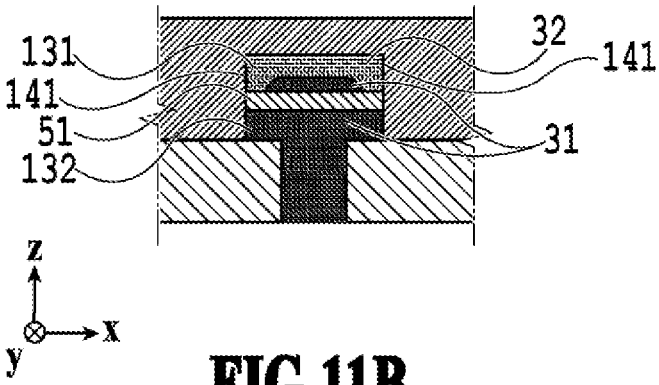
Figure 11C:
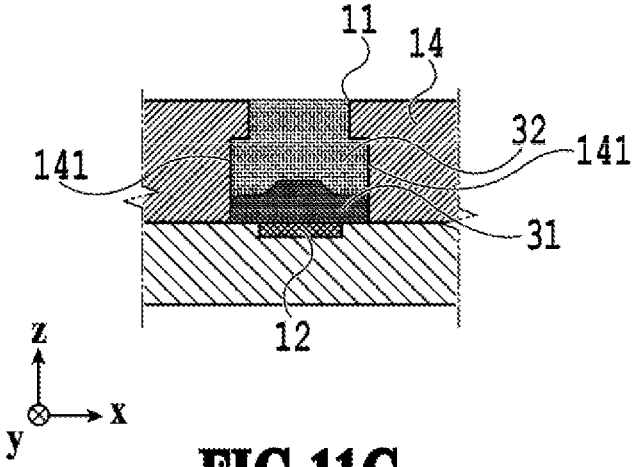
FIG. 11C is a drawing showing the pressure chamber.

Lastly, a description will be given of another example of this embodiment in which the first liquid 31 flows on the upper flow passage 132 in addition to the second liquid 32 thereon due to a high flow rate of the first liquid 31 whereas only the first liquid 31 flows on the lower flow passage 131. FIGS. 11A to 11C are drawings for explaining this example. FIG. 11A is a cross-sectional view of this example corresponding to the cross-sectional view of FIG. 8B. FIG. 11B is a cross-sectional view of this example corresponding to the cross-sectional view of FIG. 8C. Due to the high flow rate of the first liquid 31 in this example, the flow of the first liquid 31 in the lower flow passage 131 has not only the spread in the direction toward the wall surface 141 of the liquid flow passage 13 but also a flow in an opposite direction from the direction of flow of the liquids in the liquid flow passage 13. For this reason, the first liquid 31 flows to the upper flow passage 132 along the lateral wall 51 whereby the first liquid 31 flows between the second liquid 32 and the lateral wall 51 in the upper flow passage 132. The liquids flowing on the upper flow passage 132 and the lower flow passage 131 join together at the end portion on the downstream side of the lateral wall 51.

FIG. 11C is a cross-sectional view of this example corresponding to the cross-sectional view of FIG. 8E. The liquid-liquid interface is formed in the pressure chamber 18 such that the first liquid 31 and the second liquid 32 are stacked in the height direction (the z direction). Accordingly, the first liquid 31 comes into contact with the pressure generating element 12 and the second liquid 32 is present in the vicinity of the ejection port 11. As a consequence, it is possible to stably generate a bubble of the first liquid 31 with the pressure generating element 12 and to eject the second liquid 32 in this example as well. However, in this example, the first liquid 31 may be mixed at the time of ejection due to the high flow rate of the first liquid 31.

As described above, the presence of the lateral wall 51 makes the first liquid 31 flow while spreading in the width direction of the liquid flow passage such that the first liquid 31 is located above the heater. Thus, it is more likely that the liquid-liquid interface is formed such that the first liquid 31 and the second liquid 32 flow in the z direction in the liquid flow passage 13 while being stacked on each other. Even in a case where any of flow rates and physical properties of the first liquid 31 and the second liquid 32 is changed, the lateral wall 51 can create the liquid-liquid interface such that the first liquid 31 flows in contact with the pressure generating element 12 and that the second liquid 32 is present in the vicinity of the ejection port 11. As a consequence, it is possible to stably generate a bubble of the first liquid 31 with the pressure generating element 12 and to eject the second liquid 32.

(Length of Lateral Wall)

Figure 12:
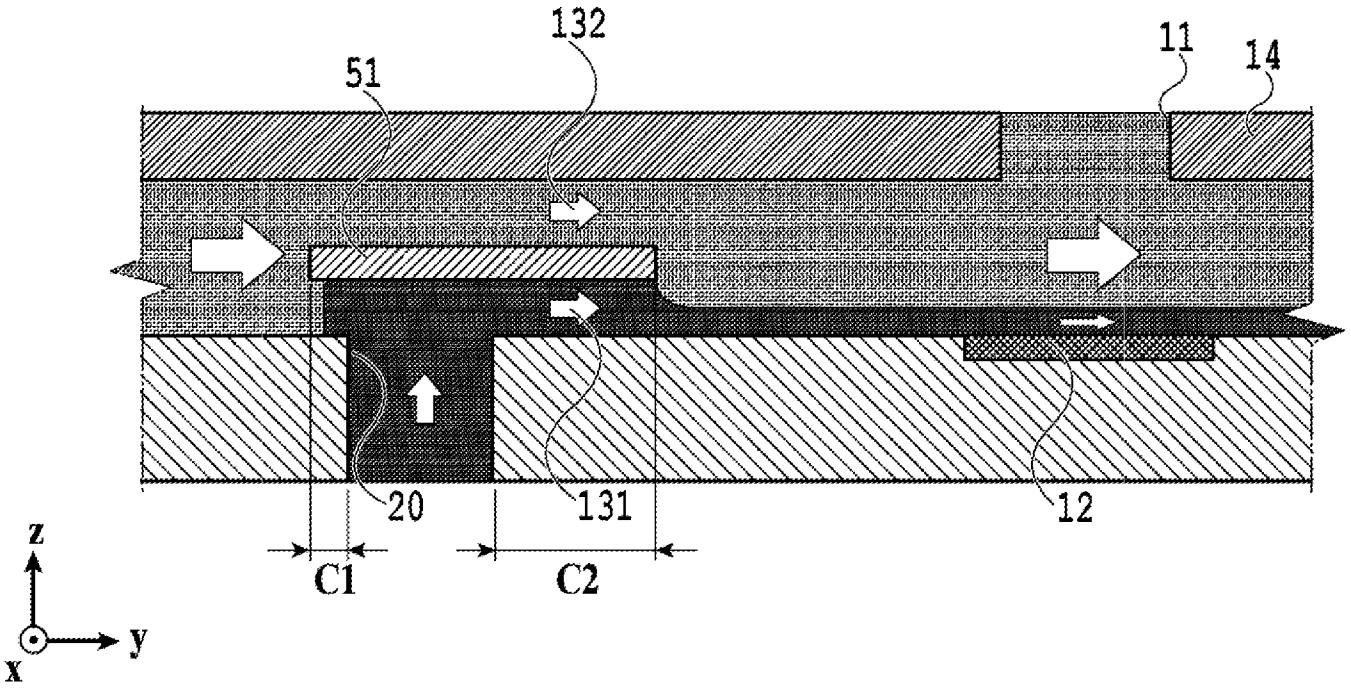
FIG. 12 is a diagram for explaining clearances of the lateral wall.

FIG. 12 is an enlarged diagram of the neighborhood of the lateral wall 51 in FIG. 8B. A configuration of the lateral wall 51 will be described based on FIG. 12. A distance between an end portion on the upstream side of the lateral wall 51 in the direction of flow of the liquids (the y direction) in the liquid flow passage 13 and an open end on the upstream side of the first inflow port 20 in the direction of flow of the liquids in the liquid flow passage 13 will be defined as a first clearance C1. Meanwhile, a distance between the end portion on the downstream side of the lateral wall 51 in the direction of flow of the liquids in the liquid flow passage 13 and an open end on the downstream side of the first inflow port 20 in the direction of flow of the liquids in the liquid flow passage 13 will be defined as a second clearance C2. A state where one of the end portions of the lateral wall 51 is located inside of the first inflow port 20 will be defined as a negative clearance (C1<0 or C2<0). In other words, each of the end portions on the upstream side and the downstream side of the lateral wall in FIG. 12 is located outside the first inflow port 20 (on the flow passage side). Accordingly, the first clearance C1 and the second clearance C2 of the lateral wall 51 in FIG. 12 satisfy C1>0, and C2>0, respectively.

In order to cause the second liquid 32 to flow on the upper flow passage 132 and to cause the first liquid 31 to flow on the lower flow passage 131, it is preferable to set the second clearance C2 on the downstream side of the lateral wall 51 to C2≥0.

In the case where the second clearance on the downstream side of the lateral wall 51 satisfies C2<0, then there is a region where the lateral wall 51 is not provided at a position opposed to the first inflow port 20. In the region without the lateral wall 51 at the position opposed to the first inflow port 20, the first liquid 31 discharged from the first inflow port 20 directly joins the second liquid 32 without colliding against the lateral wall 51, and then flows in the liquid flow passage 13 as with the aforementioned comparative example. The effect of the lateral wall 51 is therefore diminished. As a consequence, a liquid-liquid interface that renders an arrangement of the first liquid 31 and the second liquid 32 in the width direction (the x direction) of the liquid flow passage 13 is apt to be formed as with the comparative example of FIG. 6D in the pressure chamber 18.

Figure 13A:
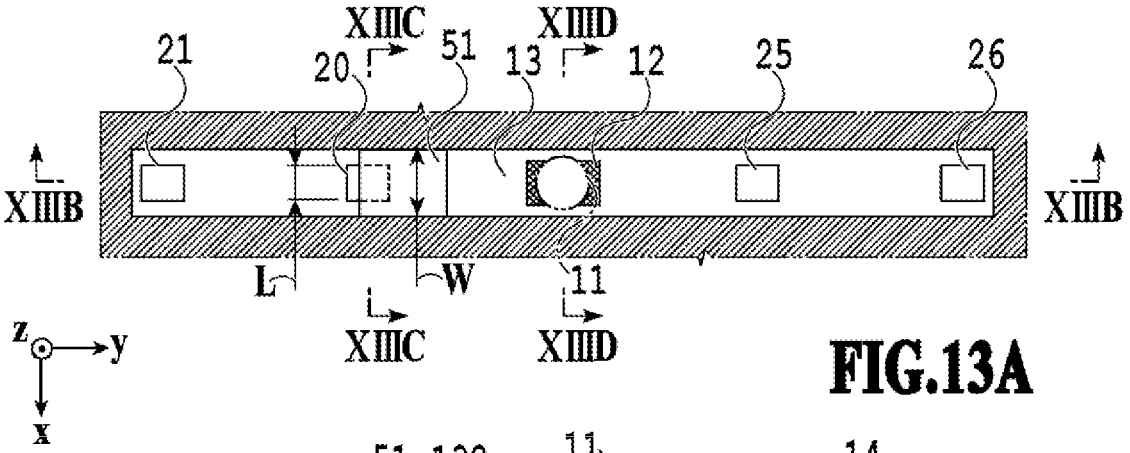
FIGS. 13A to 13C are drawings showing the liquid flow passage for explaining the lateral wall.
Figure 13B:
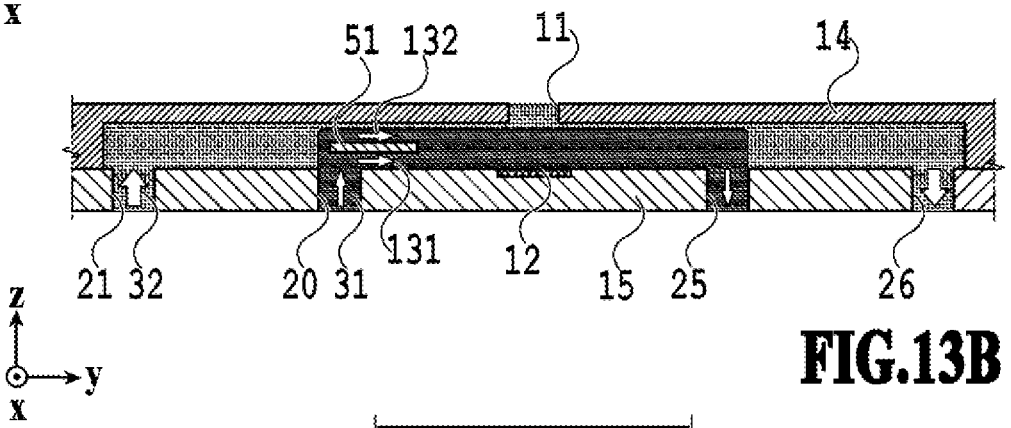
Figure 13C:
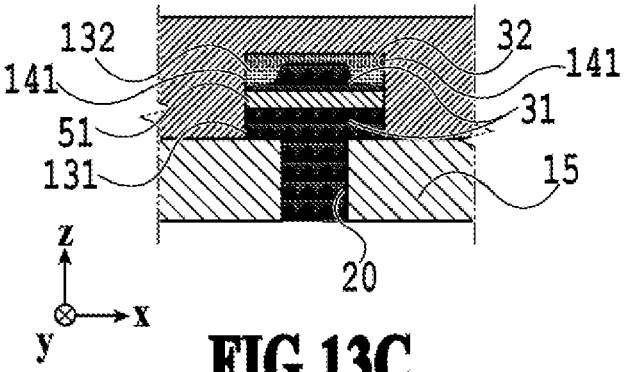
Figure 13D:
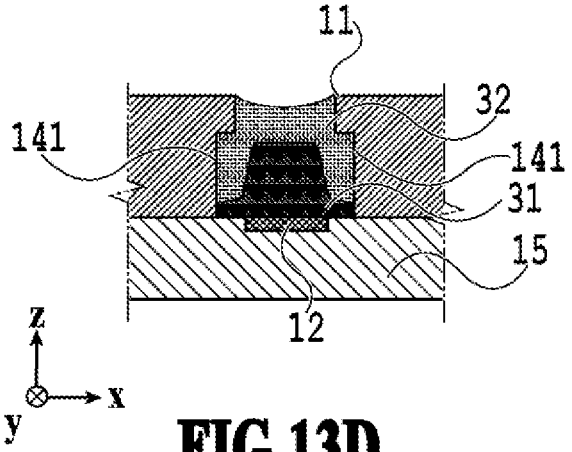
FIG. 13D is a drawing showing the pressure chamber.

FIGS. 13A to 13D are diagrams for explaining the case in which the first clearance C1 of the lateral wall 51 satisfies C1<0. FIG. 13A is a perspective view from the ejection port 11 side (from the +z direction side) and FIGS. 13B to 13D are cross-sectional views taken along the XIIIB-XIIIB line, the XIIIC-XIIIC line, and the XIIID-XIIID line in FIG. 13A, respectively.

In the case where the first clearance C1 of the lateral wall 51 satisfies C1<0, the first liquid 31 discharged from the first inflow port 20 is more likely to flow on the upper flow passage 132 as compared to the case of C1>0 in FIG. 12. In this instance, the first liquid 31 is less likely to flow in the vicinity of the wall surfaces 141 and a ceiling (the orifice plate 14) of the liquid flow passage 13 on the upper flow passage 132. Therefore, the second liquid 32 flows in the vicinity of the wall surfaces 141 and the ceiling on the upper flow passage 132 instead. As a consequence, the liquid-liquid interface is formed in the upper flow passage 132 such that the second liquid 32 covers the first liquid 31 as shown in FIG. 13C. The liquids flowing on the upper flow passage 132 and the lower flow passage 131 join together at the end portion on the downstream side of the lateral wall 51, whereby a liquid-liquid interface shown in FIG. 13D is formed in the pressure chamber 18.

Figure 14A:
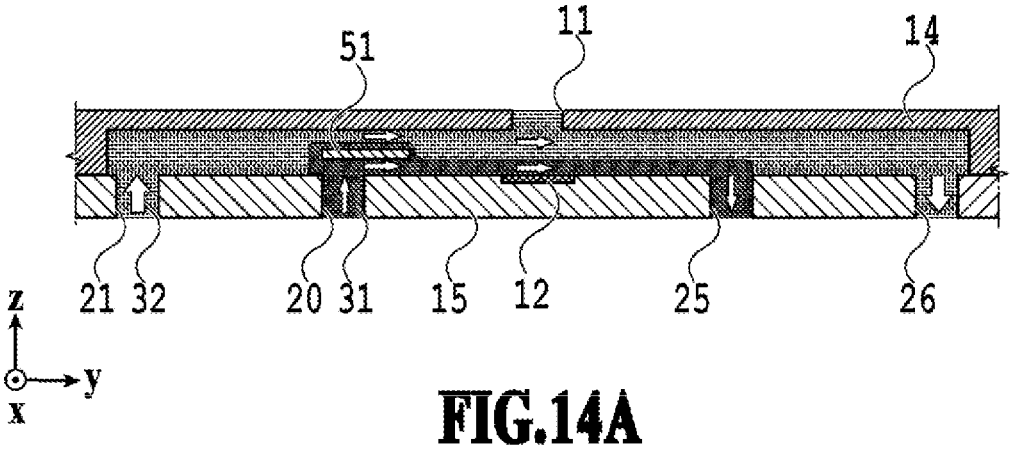
FIGS. 14A and 14B are drawings showing the liquid flow passage for explaining the lateral wall.
Figure 14B:
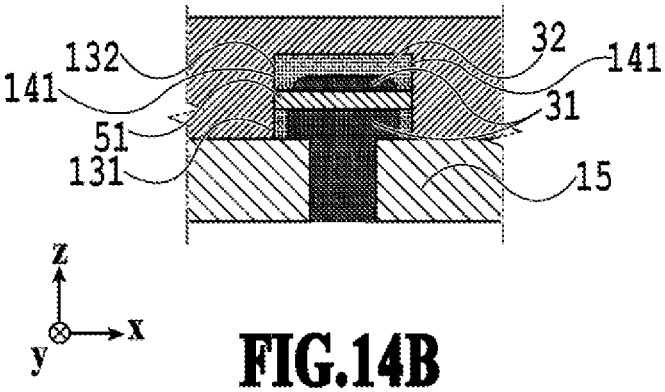
Figure 14C:
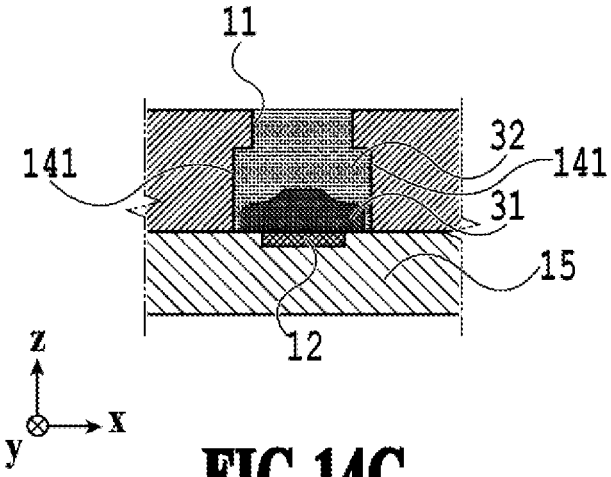
FIG. 14C is a drawing showing the pressure chamber.

FIGS. 14A to 14C are diagrams showing another example of the case in which the first clearance C1 of the lateral wall 51 satisfies C1<0. FIG. 14A is a cross-sectional view equivalent to FIG. 13B, FIG. 14B is a cross-sectional view equivalent to FIG. 13C, and FIG. 14C is a cross-sectional view equivalent to FIG. 13D, respectively. In this example, the flow rate of the first liquid 31 is lower than that in the example of FIGS. 13A to 13D. Hence, the flow rate of the first liquid 31 flowing to the upper flow passage 132 becomes lower. Accordingly, the amount of the first liquid 31 present in the vicinity of the ejection port 11 in the pressure chamber 18 can be reduced as shown in FIG. 14C. As a consequence, it is possible to increase the percentage of the second liquid 32 in the liquid to be ejected from the ejection port 11.

As described above, even in the case where the first clearance C1 of the lateral wall 51 satisfies C1<0, it is still possible to cause the first liquid 31 to flow in contact with the pressure generating element 12 in the pressure chamber 18 and to form the liquid-liquid interface such that the second liquid 32 is present in the vicinity of the ejection port 11. As a consequence, it is possible to stably generate a bubble of the first liquid 31 with the pressure generating element 12 and to eject the second liquid 32. However, it is more likely that the first liquid 31 is included in the liquid to be ejected from the ejection port 11 in the case where the first clearance C1 of the lateral wall 51 satisfies C1<0 as compared to the case where the first clearance C1 satisfies C1≥0.

(Width of Lateral Wall)

Figure 15:
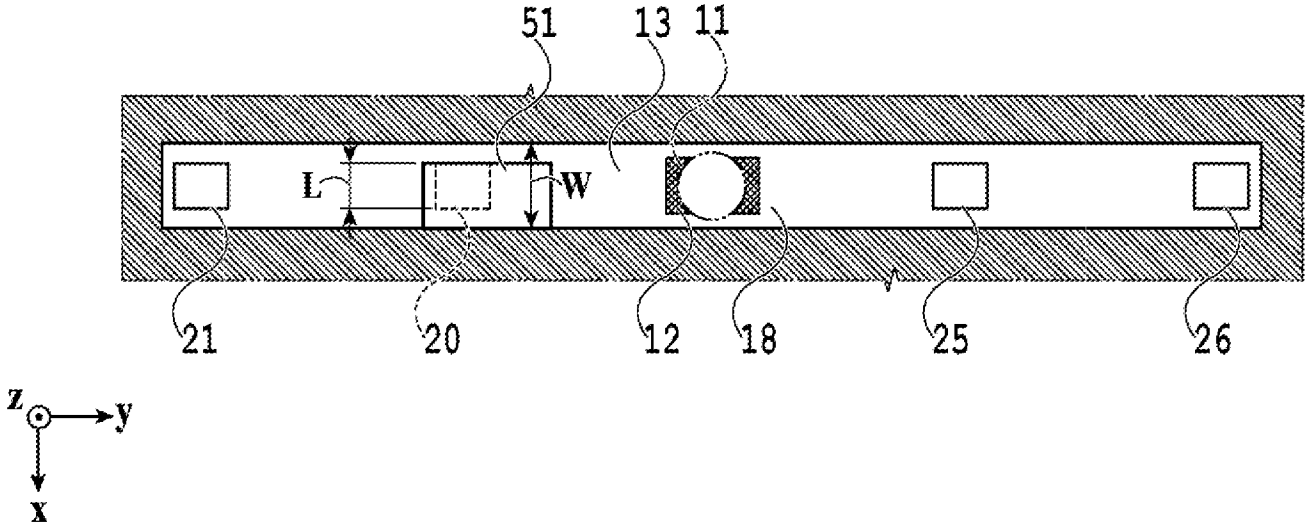
FIG. 15 is a diagram for explaining a lateral wall having a different length in a width direction.

FIG. 15 is a perspective view from the ejection port 11 side (from the +z direction side), which is a diagram showing an example in which one end portion in the width direction of the lateral wall 51 is in contact with one of the wall surfaces of the liquid flow passage 13 whereas the other end portion thereof does not reach the other wall surface of the liquid flow passage 13. In order to cause the first liquid 31 and the second liquid 32 to flow in the pressure chamber 18 while being stacked on each other in the height direction, the length in the width direction of the lateral wall 51 preferably has the same length as the length W in the width direction of the liquid flow passage 13. Nonetheless, the same effects as those in the case where the length in the width direction of the lateral wall 51 is equal to the length W in the width direction of the liquid flow passage 13 are available even in the case where the length in the width direction of the lateral wall 51 is smaller than the length W in the width direction of the liquid flow passage 13 as in this example. However, in the case where the length in the width direction of the lateral wall 51 is smaller than the length W in the width direction of the liquid flow passage 13, it is preferable to arrange the lateral wall 51 in such a way as to cover the opening of the first inflow port 20 as shown in FIG. 15 so as to cause the first liquid 31 flowing in from the first inflow port 20 to collide against the lateral wall 51. Meanwhile, in the case where the other end portion in the width direction of the lateral wall 51 does not reach the wall surface of the liquid flow passage 13, the lateral wall 51 may be supported by a member such as a pillar that projects from the ceiling (the orifice plate 14) of the liquid flow passage 13. In this way, even in the case where the contact area between the lateral wall 51 and the wall surface is small and a point of contact therebetween has a small strength, it is still possible to securely fix the lateral wall 51 into the liquid flow passage 13 by supporting the lateral wall 51 at two locations, namely, at the point of contact between the lateral wall 51 and the wall surface and at a point of contact between the lateral wall 51 and the pillar. In the meantime, in the case where the length in the width direction of the lateral wall 51 is smaller than the length W in the width direction of the liquid flow passage 13, the lateral wall 51 may be kept from coming into contact with the right and left side walls of the liquid flow passage 13. In this case as well, the lateral wall 51 may be supported by members such as pillars that project from the ceiling (the orifice plate 14) of the liquid flow passage 13, for example.

As described above, according to this embodiment, it is possible to stably form the liquid-liquid interface such that the first liquid 31 and the second liquid 32 flow side by side in the height direction (the z direction) in the pressure chamber 18. Accordingly, the first liquid 31 comes into contact with the pressure generating element 12 while the second liquid 32 is present on the ejection port side. Thus, it is possible to eject the second liquid 32 by generating a bubble of the first liquid 31 with the pressure generating element 12.

Here, any of the first liquid and the second liquid flowing in the pressure chamber 18 may be circulated between the pressure chamber 18 and an outside unit. If the circulation is not conducted, a large amount of any of the first liquid and the second liquid having formed the parallel flows in the liquid flow passage 13 and the pressure chamber 18 but having not been ejected would come into being. Accordingly, the circulation of the first liquid and the second liquid with the outside units makes it possible to use the liquids that have not been ejected for the purpose of forming the parallel flows again.

(Specific Examples of First Liquid and Second Liquid)

According to the configuration of the embodiment described above, the main functions required in the first liquid and the second liquid are clarified. Specifically, the first liquid may typically be the bubbling medium for developing the film boiling while the second liquid may typically be the ejection medium to be ejected to the atmosphere. The configuration of this embodiment can improve the degree of freedom of components to be contained in the first liquid and the second liquid as compared to the related art. Now, the bubbling medium (the first liquid) and the ejection medium (the second liquid) in this configuration will be described below in detail based on specific examples.

For instance, the bubbling medium (the first liquid) of this embodiment is required to have a high critical pressure to enable development of the film boiling in the media upon heat generation of the electrothermal converter and a rapid growth of the bubble thus generated, or in other words, to enable efficient transformation of thermal energy into bubbling energy. Water is suitable for such a medium in particular. Water has the high boiling point (100° C.) and the high surface tension (58.85 dyne/cm at 100° C.) despite its small molecular weight of 18, and therefore has a high critical pressure of about 22 MPa. In other words, water also exhibits an extremely large bubbling pressure at the time of film boiling. In general, an inkjet printing apparatus adopting the mode of ejecting an ink by use of the film boiling favorably uses an ink prepared by causing water to contain a coloring material such as a dye and a pigment.

Nevertheless, the bubbling medium is not limited to water. Any other substances may function as the bubbling medium as long as such a substance has the critical pressure equal to or above 2 MPa (or preferably equal to or above 5 MPa). Examples of the bubbling medium other than water include methyl alcohol and ethyl alcohol. It is also possible to use a mixture of any of these liquids with water. Meanwhile, it is also possible to use a medium prepared by adding the aforementioned coloring material such as a dye and a pigment, an additive, and the like to water.

On the other hand, the physical properties to enable the film boiling as in the case of the bubbling medium is not required in the ejection medium (the second liquid) of this embodiment, for example. In the meantime, adhesion of a scorched material onto the electrothermal converter (the heater) may deteriorate the bubbling efficiency due to damage on flatness of a heater surface or deterioration in heat conductivity. Nonetheless, the ejection medium does not come into contact directly with the heater and therefore does not bring about any scorched component on the heater. In other words, the ejection medium of this embodiment is exempted from the physical conditions required for developing the film boiling and for avoiding the scorch as the relevant conditions required in a conventional ink for a thermal head, whereby the degree of freedom of the components is improved. As a consequence, the ejection medium can more actively contain components suitable for applications after the ejection.

For example, the pigment that has heretofore been unused because it was easily scorched on the heater may be more actively contained in the ejection medium in this embodiment. In the meantime, a liquid other than an aqueous ink, which has an extremely low critical pressure, can also be used as the ejection medium in this embodiment. Moreover, it is also possible to use various inks having special functions which can hardly be handled by the conventional thermal head, such as an ultraviolet curable ink, an electrically conductive ink, an electron-beam (EB) curable ink, a magnetic ink, and a solid ink, can also be used as the ejection media. In the meantime, the liquid ejection head of this embodiment can also be used in various applications other than image formation by using any of blood, cells in culture, and the like as the ejection media. The liquid ejection head is also adaptable to other applications including biochip fabrication, electronic circuit printing, and so forth. Since there are no restrictions regarding the second liquid, the second liquid may adopt the same liquid as one of those cited as the examples of the first liquid. For instance, even if both of the two liquids are inks each containing a large amount of water, it is still possible to use one of the inks as the first liquid and the other ink as the second liquid depending on situations such as a mode of usage.

Second Embodiment

This embodiment describes another mode of the liquid ejection head 1 in which the first liquid 31 and the second liquid 32 flow in the pressure chamber 18 while being stacked on each other in the height direction (the vertical direction). This embodiment will be described while being mainly focused on different features from those of the first embodiment. In this context, the features not specifically mentioned in this embodiment should be regarded the same as those in the first embodiment.

(Relation Between Water Phase Thickness and Confluence Wall)

Figure 16A:
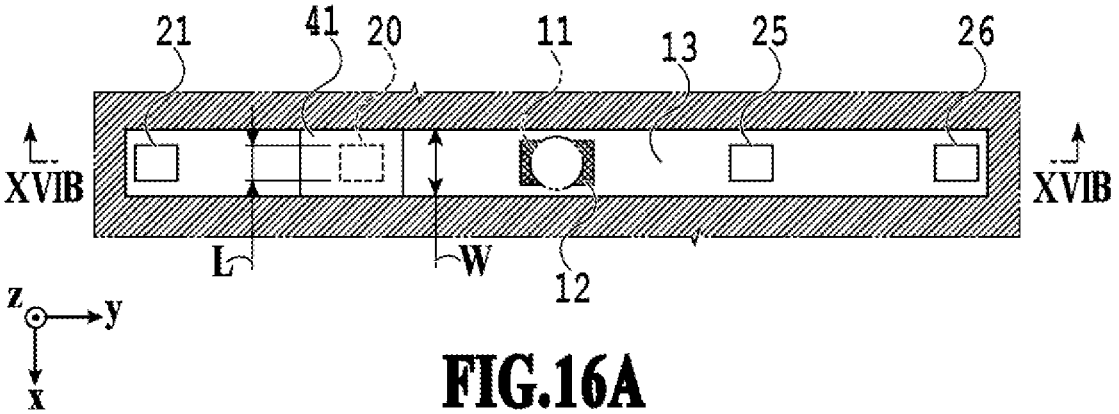
FIGS. 16A to 16C are enlarged detail drawings showing the liquid flow passage and the pressure chamber for explaining a confluence wall.
Figure 16B:
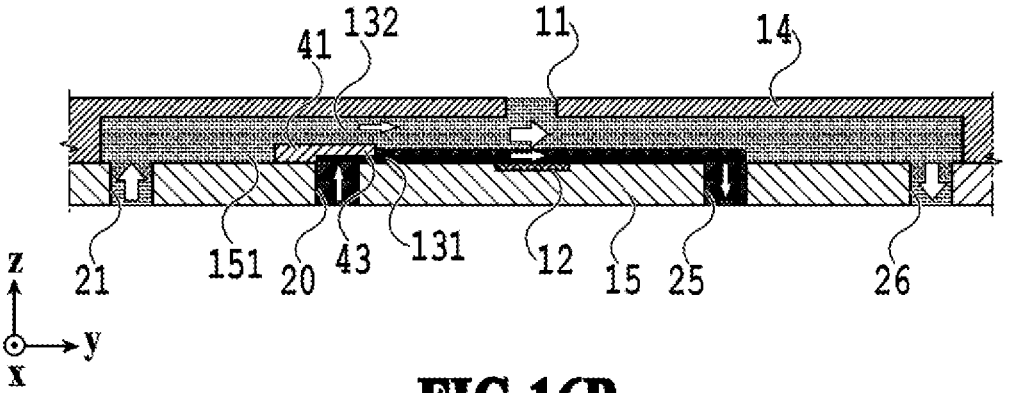
Figure 16C:
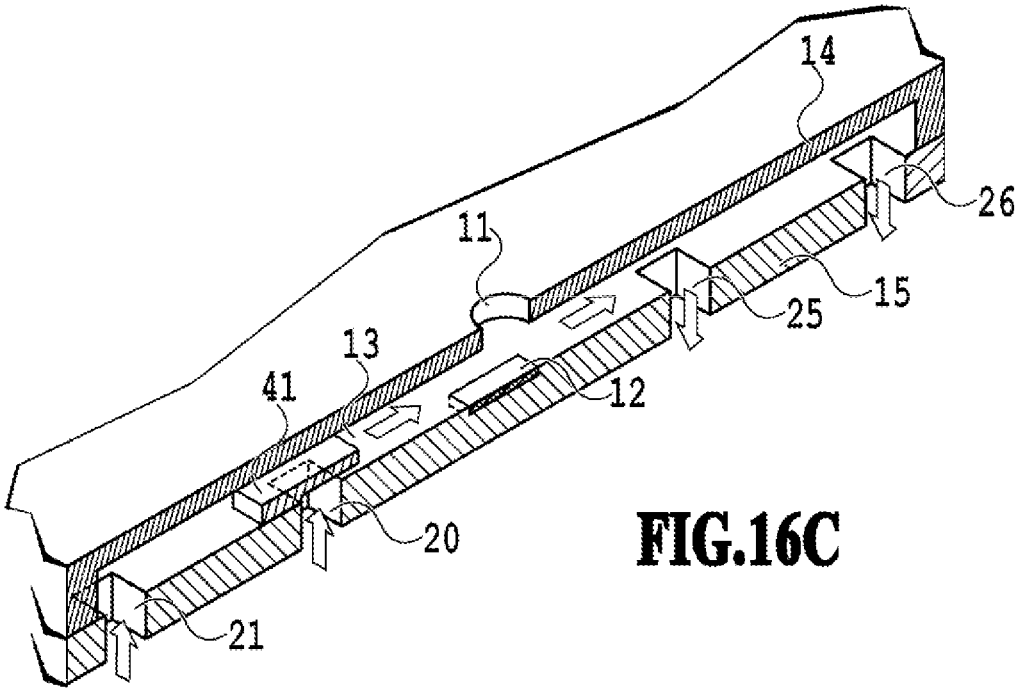

FIGS. 16A to 16C are diagrams showing one liquid flow passage and one pressure chamber 18 formed in the element board 10 of this embodiment. FIG. 16A is a perspective view from the ejection port 11 side (from the +z direction side) and FIG. 16B is a cross-sectional view taken along the XVIB-XVIB line in FIG. 16A. Meanwhile, FIG. 16C is an enlarged diagram of the neighborhood of one of the liquid flow passages 13 in the element board.

As shown in FIG. 16B, this embodiment includes a confluence wall (a vertical wall) 41 provided on a surface 151 located on the upstream side of the first inflow port 20 in the direction of flow of the liquids (the y direction) in the liquid flow passage 13 where the substrate 15 comes into to contact with the liquid. The confluence wall 41 is a wall portion (a second wall) that projects from the surface 151 on the liquid flow passage 13 side of the substrate 15. Of end portions of the confluence wall 41, an end portion on the downstream side in the direction of flow of the liquids in the liquid flow passage 13 is provided in such a way as to be located above the open end on the upstream side of the first inflow port 20 in the direction of flow of the liquids in the liquid flow passage 13.

Moreover, the confluence wall 41 is provided with a projection 43 (a lateral wall) that projects downstream in the direction of flow of the liquids. The confluence wall 41 and the projection 43 are integrally formed and the projection 43 is formed to be opposed to the first inflow port 20. Since the confluence wall 41 is disposed on the upstream side of the first inflow port 20, the confluence wall 41 blocks the second liquid 32 from flowing into the lower flow passage 131. Accordingly, a large flow of the first liquid 31 as compared to the case of not installing the confluence wall 41 is created between the first inflow port 20 and each of the wall surfaces of the liquid flow passage 13 located on the right and left sides in the direction of flows in the liquid flow passage 13. As a consequence, the first liquid 31 flows on the lower flow passage 131 and the second liquid 32 flows on the upper flow passage 132 thanks to the confluence wall 41. Here, as shown in FIG. 16, a length in the width direction of the confluence wall 41 is preferably equal to the length W in the direction of the liquid flow passage.

(Relation Between Water Phase Thickness and Projecting Amount of Projection)

Figure 17A:
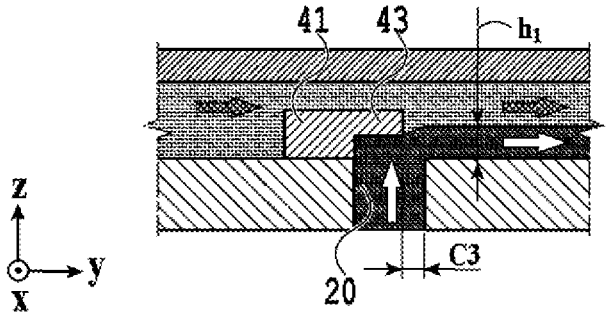
FIGS. 17A to 17E are diagrams for explaining a clearance and a confluence wall height of the confluence wall.
Figure 17B:
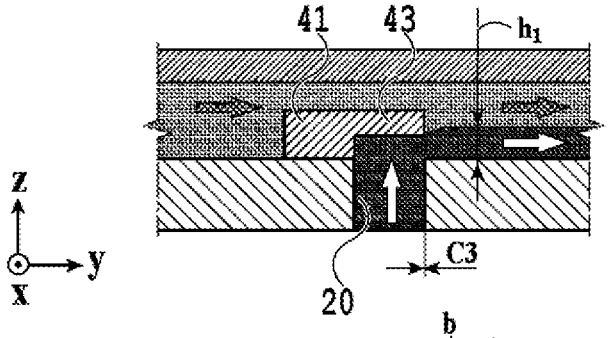
Figure 17C:
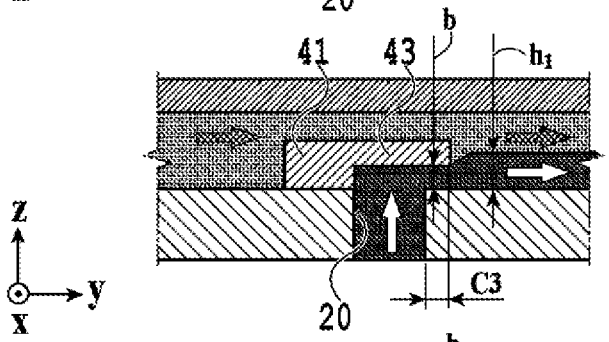

FIGS. 17A to 17C are enlarged diagrams of the neighborhood of the confluence wall 41 in FIG. 16C, which are diagrams for explaining projecting amounts of the projection 43 of the confluence wall 41. A distance between an end portion on the downstream side (the +y direction) of the projection 43 and the open end on the downstream side (the +y direction) of the first inflow port 20 will be defined as a clearance C3. Meanwhile, a clearance in a state where the end portion on the downstream side of the projection 43 is located upstream of the end portion on the downstream side of the first inflow port 20 will be defined as a negative clearance (C3<0).

FIG. 17A is a diagram showing an example of the state where the clearance C3 of the projection 43 is negative (C3<0). In this example, the projection 43 does not cover the entirety of the first inflow port 20. FIG. 17B is a diagram showing an example of the state where the clearance C3 of the projection 43 is equal to zero (C3=0). In this example, the projection 43 entirely covers the first inflow port 20. FIG. 17C is a diagram showing an example of the state where the clearance C3 of the projection 43 is positive (C3>0). In this example, the projection 43 entirely covers the first inflow port 20 and a tip end of the projection 43 reaches a portion of the flow passage on the downstream side of the first inflow port 20.

The state of the clearance C3 equal to or above 0 (C3≥0) representing a configuration to entirely cover the first inflow port 20 is preferable from the viewpoint of forming the liquid-liquid interface such that the first liquid 31 and the second liquid 32 flow in the pressure chamber 18 while being stacked on each other in the vertical direction. In the case where the clearance C3 of the projection 43 is negative (C3<0) as shown in FIG. 17A, the liquid to be ejected is more likely to contain the first liquid 31 as compared to the case where the clearance is equal to or above 0 (C3≥0). However, unlike the lateral wall 51 of the first embodiment, it is possible to stably eject the second liquid 32 since the confluence wall 41 keeps the second liquid 32 from flowing into the lower flow passage 131. Accordingly, if it is desirable to reduce the amount of the first liquid 31 included in the liquid ejected from the ejection port 11, the projection 43 is formed in such a way as to satisfy the clearance C3 equal to or above 0 (C3≥0). On the other hand, if the liquid ejected from the ejection port 11 needs to contain the first liquid 31, then the projection 43 is formed in such a way as to have the negative clearance C3 (C3<0).

Figure 17D:
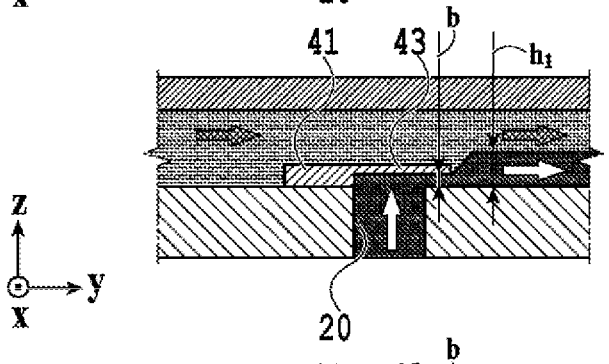
Figure 17E:
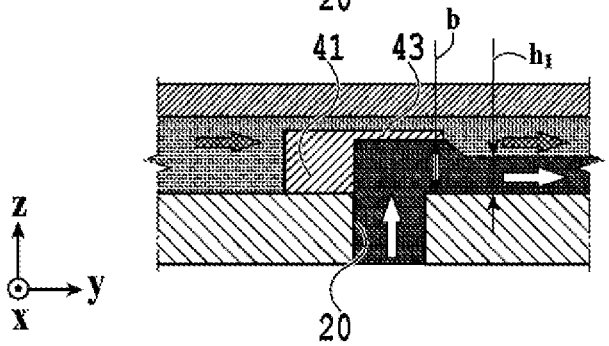

FIGS. 17C, to 17E are diagrams for explaining cases of various confluence wall heights b that represent positions in the height direction of the projection 43. FIG. 17C is a diagram showing an example in which the confluence wall height b is substantially equal to a thickness $h_1$ of a phase of the first liquid 31. FIG. 17D is a diagram showing an example in which the confluence wall height b is smaller than the thickness $h_1$ of the phase of the first liquid 31. FIG. 17E is a diagram showing an example in which the confluence wall height b is larger than the thickness $h_1$ of the phase of the first liquid 31.

The water phase thickness $h_r$ is constant in the case where the viscosity ratio and the flow rate ratio are constant. Accordingly, the thickness $h_1$ of the phase of the first liquid 31 maintains a constant thickness as long as the length in the height direction of the liquid flow passage 13 is the same. For this reason, the thicknesses $h_1$ of the phase of the first liquid 31 in the pressure chamber 18 are the same among the configurations of the projection 43 in FIGS. 17C to 17E.

In the case where a printing medium having functions necessary for print formation is used for the second liquid 32 and water serving as the bubbling medium is used for the first liquid 31 so as to enable stable ejection of the second liquid 32, the second liquid 32 has a larger viscosity than that of the first liquid 31. It is preferable to increase the supply of the second liquid 32 in this case. As the confluence wall height b becomes larger, the length in the height direction of the upper flow passage 132 located above the confluence wall 41 becomes smaller. Hence, the flow rate of the second liquid 32 flowing on the upper flow passage 132 is limited in this case. Accordingly, a configuration with a small confluence wall height b is preferred in the case of using the printing medium having the functions necessary for print formation for the second liquid 32 and using water serving as the bubbling medium for the first liquid 31.

As described above, this embodiment can also form the liquid-liquid interface such that the first liquid 31 and the second liquid 32 flow in the pressure chamber 18 while being arranged in the height direction (the vertical direction). Accordingly, the first liquid 31 comes into contact with the pressure generating element 12 and the second liquid 32 is present on the ejection port side. As a consequence, it is possible to generate a bubble of the first liquid 31 with the pressure generating element 12 and thus to eject the second liquid 32.

(First Manufacturing Method)

Figure 18A:
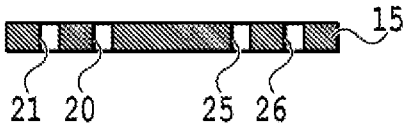

FIGS. 18A to 18H are diagrams for explaining a first method of manufacturing the element board 10 provided with the confluence wall 41 in the liquid flow passage 13 according to this embodiment. FIG. 18A is a diagram showing a cross-section of the substrate 15 which the first inflow port 20, the second inflow port 21, the first outflow port 25, and the second outflow port 26 penetrate. In the following, a manufacturing process is assumed to proceed in the order from FIG. 18A to FIG. 18H.

Figure 18B:
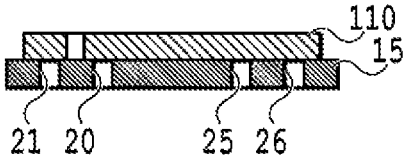

As shown in FIG. 18B, a material constituting a first pattern 110 is deposited on the substrate 15 by means of dry film lamination. The material constituting the first pattern 110 is a photosensitive resin and a positive resist (a positive-type photosensitive resin). Accordingly, the first pattern 110 is formed on the substrate 15 after conducting light exposure and development. In addition, the first pattern 110 has a structure to cover the first inflow port 20, the second inflow port 21, the first outflow port 25, and the second outflow port 26. The first pattern 110 serves as a mold for forming part of an internal space of the liquid flow passage 13. In this regard, the first pattern 110 will be removed in a later step.

Figure 18C:
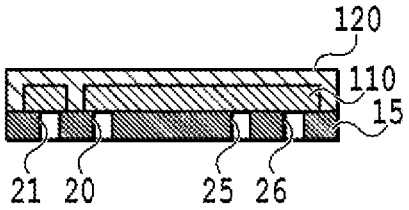

Next, as shown in FIG. 18C, a first covering layer 120 is deposited on the substrate 15 provided with the first pattern 110. A material constituting the first covering layer 120 is a photosensitive resin which is preferably a negative resist (a negative-type photosensitive resin). The following description will be made on the assumption that the negative-type photosensitive resin is used as the material of the first covering layer 120.

Figure 18D:
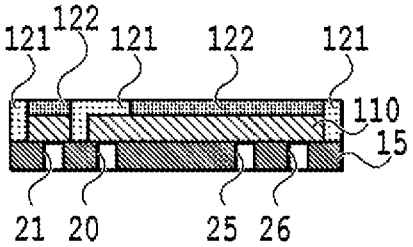

Next, as shown in FIG. 18D, the first covering layer 120 is exposed to a light pattern. After the light exposure, a development process is not performed in this step and an unexposed portion 122 of the first covering layer 120 is reserved as a latent image. An exposed portion 121 of the first covering layer 120 will constitute the confluence wall 41 and part of the orifice plate 14 serving as a formation member to form the liquid flow passage 13.

Figure 18E:
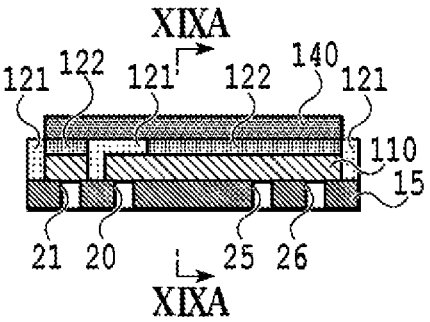

Next, as shown in FIG. 18E, a material constituting a second pattern 140 is deposited on the first covering layer 120. Deposition of the material constituting the second pattern 140 is conducted by use of a dry film. The material constituting the second pattern 140 is a photosensitive resin and a positive resist (a positive-type photosensitive resin). In the meantime, the material constituting the second pattern 140 is preferably a material that has a light absorption effect. The second pattern 140 serves as a mold for forming part of the internal space of the liquid flow passage 13. In this regard, the second pattern 140 will be removed in a later step.

Figure 19A:
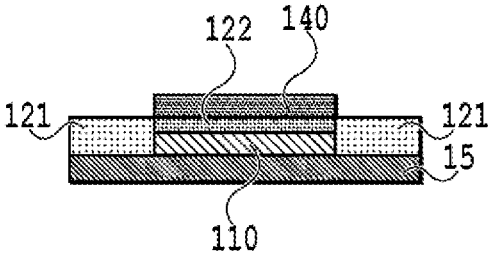
FIGS. 19A to 19C are schematic cross-sectional views for explaining the method of manufacturing an element board including a confluence wall.

FIG. 19A is a diagram showing an example of a cross-sectional view taken along the XIXA-XIXA line in FIG. 18E. The exposed portion 121 of the first covering layer 120 is provided on two sides of the unexposed portion 122 of the first covering layer 120. Meanwhile, the unexposed portion 122 of the first covering layer 120 is deposited on the first pattern 110. Moreover, the second pattern 140 is deposited in such a way as to cover the unexposed portion 122 of the first covering layer 120.

Figure 18F:
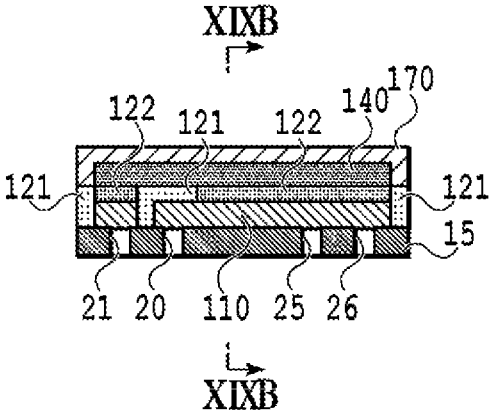
Figure 19B:
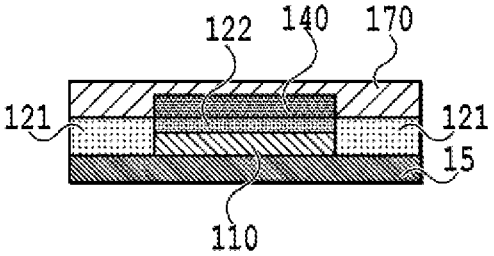

Next, a second covering layer 170 is deposited as shown in FIG. 18F. In this manufacturing method, a material used for forming the second covering layer 170 is the same material as the material for forming the first covering layer 120. The second covering layer 170 constitutes part of the orifice plate 14 serving as the formation member to form the liquid flow passage 13. FIG. 19B is a diagram showing an example of a cross-sectional view taken along the XIXB-XIXB line in FIG. 18F.

Next, as shown in FIG. 18G, the ejection port 11 is formed by exposing and developing a portion of the second covering layer 170 corresponding to the ejection port. In this instance, the unexposed portion 122 of the first covering layer 120 is covered with the second pattern 140 formed by using the material having the light absorption effect. Accordingly, light associated with the light exposure for forming the ejection port 11 is shielded by the second pattern 140. In this way, it is possible to keep the unexposed portion 122 of the first covering layer 120 from being affected by the light exposure for forming the ejection port 11.

Figure 18H:
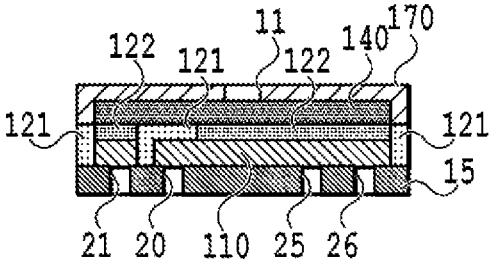
Figure 18H:
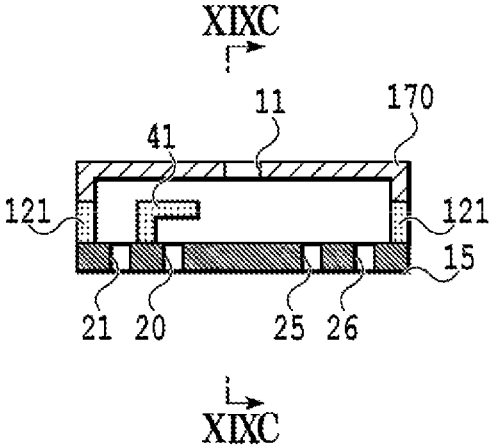
Figure 19C:
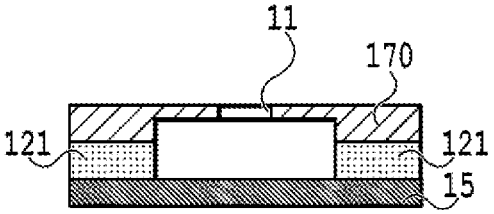

Next, the first pattern 110, the second pattern 140, and the unexposed portion 122 of the first covering layer 120 are removed as shown in FIG. 18H. FIG. 19C is a diagram showing an example of a cross-sectional view taken along the XIXC-XIXC line in FIG. 18H.

As described above, according to this manufacturing method, the unexposed portion 122 of the first covering layer 120 is not developed at the time of deposition of the first covering layer 120. Thus, the second pattern 140 can be deposited on the unexposed portion 122 of the first covering layer 120. In this way, the second pattern 140 can be deposited flatly while preventing the second pattern 140 from sagging. Moreover, the second covering layer 170 that constitutes part of the orifice plate can be deposited on the flatly deposited second pattern 140. Accordingly, it is possible to suppress the development of a height difference on the orifice plate and to reduce the thickness distribution thereof. As a consequence, it is possible to manufacture the element board for the inkjet printing head with reduced height differences among the ejection ports.

Meanwhile, the second liquid 32 flows in the liquid flow passage 13 while being in contact with the orifice plate. In this way, the second liquid 32 can flow in the liquid flow passage 13 as a laminar flow thanks to the orifice plate without a height difference. In this regard, it is also effective to manufacture the orifice plate without a height difference in order for the first liquid 31 and the second liquid 32 to form the parallel flows in the state of laminar flows.

(Second Manufacturing Method)

Figure 20A:
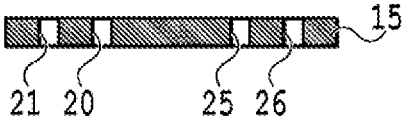
FIGS. 20A to 20H are diagrams for explaining another method of manufacturing an element board including a confluence wall.
Figure 20B:
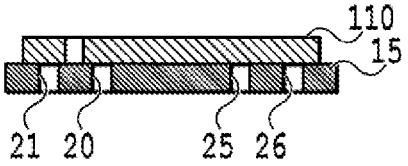
Figure 20C:
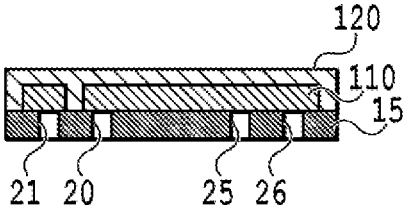
Figure 20D:
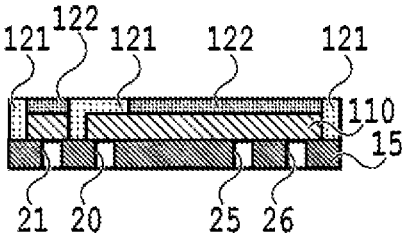
Figure 20E:
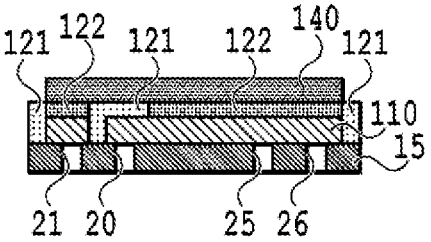

FIGS. 20A to 20H are diagrams for explaining a second method of manufacturing the element board 10 provided with the confluence wall 41 in the liquid flow passage 13 according to this embodiment. FIG. 20A is a diagram showing a cross-section of the substrate 15 which the first inflow port 20, the second inflow port 21, the first outflow port 25, and the second outflow port 26 penetrate. In the following, a manufacturing process is assumed to proceed in the order from FIG. 20A to FIG. 20H. Note that the steps illustrated in FIGS. 20B to 20E are the same steps as those illustrated in FIGS. 18B to 18E and the description thereof will be omitted.

Figure 20F:
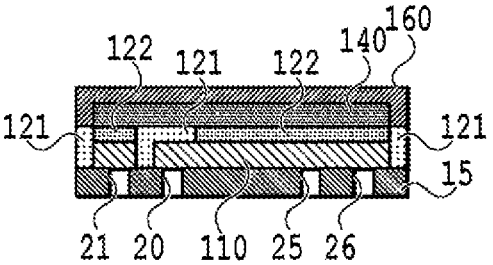

After the second pattern 140 is formed, a second covering layer 160 is formed as shown in FIG. 20F. In this manufacturing method, a material used for forming the second covering layer 160 is a different material from the material for forming the first covering layer 120. Although a negative-type photosensitive resin is used for the material of the second covering layer 160 in this manufacturing method as well, the negative-type photosensitive resin used for forming the second covering layer 160 is a material having higher sensitivity of its unexposed portion than that of the negative-type photosensitive resin for forming the first covering layer 120.

Figure 20G:
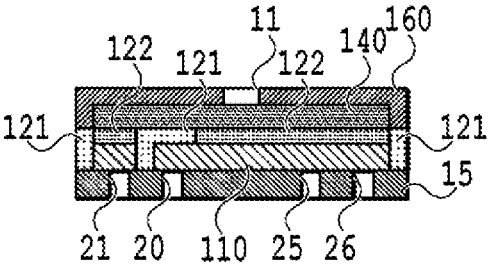
Figure 20H:
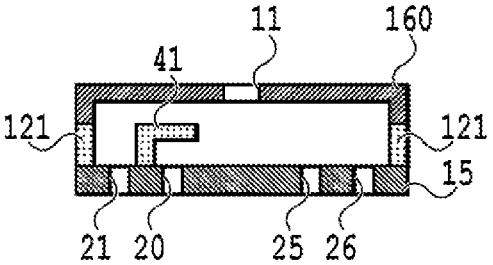

Next, as shown in FIG. 20G, the ejection port 11 is formed by exposing and developing a portion of the second covering layer 160 corresponding to the ejection port. The step in FIG. 20H is the same as the step in FIG. 18H and the description thereof will be omitted.

As described above, according to this manufacturing method, the material having the higher sensitivity of the unexposed portion than that of the material for forming the first covering layer 120 is used as the material for forming the second covering layer 160. As a consequence, it is possible to further suppress the adverse effect on the unexposed portion 122 of the first covering layer 120, which is associated with the light exposure process on the second covering layer 160, as compared to the first manufacturing method.

First Example

A liquid ejection head was manufactured in accordance with the following process. This example represents a manufacturing example based on the first manufacturing method. First, a heat-generating resistor serving as the energy generation element was formed on a silicon substrate having the diameter of ϕ200 mm. Then, the first inflow port, the second inflow port, the first outflow port, and the second outflow port were formed in the silicon substrate. Next, the first pattern was formed on the substrate by applying a positive resist ODUR-1010A manufactured by Tokyo Ohka Kogyo Co., Ltd., then subjecting the photoresist to light exposure of a flow passage pattern with an exposure machine, and then forming the pattern by conducting the development. Moreover, a cationic polymerization epoxy resin solution was spin-coated as the first covering layer on the substrate provided with the flow passage pattern. Thus, an epoxy resin layer was formed.

Thereafter, the epoxy resin layer serving as the first covering layer was subjected to light exposure, and then the positive resist ODUR-1010A manufactured by Tokyo Ohka Kogyo Co., Ltd. was deposited as the second pattern on the epoxy resin layer without conducting the development of the unexposed portion. The deposition was conducted by means of dry film lamination. Next, an epoxy resin layer which is the same as the epoxy resin layer serving as the first covering layer was deposited as the second covering layer. After conducting the light exposure and the development, the unexposed portions of all the layers, the first pattern, and the second pattern were removed.

The surfaces of the resin layers on the substrate and surfaces of partition walls were flat. Hence, the element board for the liquid ejection head with small thickness distribution on the orifice plate was successfully manufactured. Moreover, the liquid ejection head was successfully manufactured by cutting, mounting, and assembling this liquid ejection head wafer.

Second Example

A liquid ejection head was manufactured in accordance with the following process. This example represents a manufacturing example based on the second manufacturing method. The process to deposit the first pattern and the first covering layer was the same as that in the first example. Thereafter, the epoxy resin layer serving as the first covering layer was subjected to light exposure, and then the positive resist ODUR-1010A manufactured by Tokyo Ohka Kogyo Co., Ltd. was deposited as the second pattern on the epoxy resin layer without conducting the development of the unexposed portion. The deposition was conducted by means of dry film lamination. Next, an epoxy resin layer which has higher sensitivity than that of the epoxy resin layer constituting the first covering layer was deposited as the second covering layer. After conducting the light exposure and the development, the unexposed portions of all the layers, the first pattern, and the second pattern were removed.

The surfaces of the resin layers on the substrate and surfaces of partition walls were flat. Hence, the element board for the liquid ejection head with small thickness distribution on the orifice plate was successfully manufactured. Moreover, the liquid ejection head was successfully manufactured by cutting, mounting, and assembling this liquid ejection head wafer.

Next, as reference examples, a description will be given of examples in which the second pattern was formed after conducting the development of the unexposed portion of the first covering layer.

First Reference Example

Figure 21A:
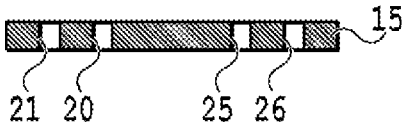
FIGS. 21A to 21H are diagrams for explaining a reference example of a method of manufacturing an element board including a confluence wall.

A liquid ejection head was manufactured in accordance with a reference example shown in FIGS. 21A to 21H. First, a heat-generating resistor serving as the energy generation element was formed on a silicon substrate having the diameter of ϕ200 mm. Then, the first inflow port 20, the second inflow port 21, the first outflow port 25, and the second outflow port 26 were formed in the substrate 15 as shown in FIG. 21A.

Figure 21B:
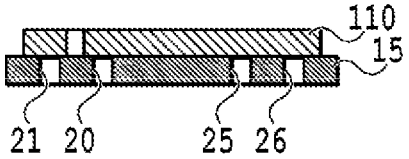

As shown in FIG. 21B, the first pattern 110 was formed on the substrate by applying the positive resist ODUR-1010A manufactured by Tokyo Ohka Kogyo Co., Ltd., then subjecting the photoresist to light exposure of a flow passage pattern with an exposure machine, and then forming the pattern by conducting the development.

Figure 21C:
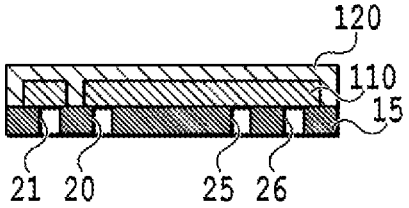

As shown in FIG. 21C, the cationic polymerization epoxy resin solution was spin-coated as the first covering layer 120 on the substrate provided with the flow passage pattern. Thus, an epoxy resin layer was formed. FIGS. 21A to 21C described so far are the drawings for explaining the process up to the deposition of the first pattern and the first covering layer. This process is the same as the corresponding process in the first example.

Figure 21D:
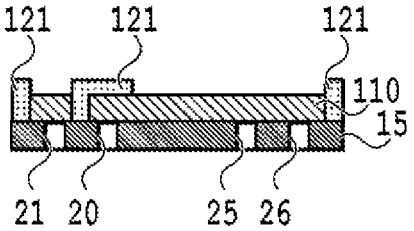

As shown in FIG. 21D, the epoxy resin layer serving as the first covering layer 120 was subjected to light exposure and the unexposed portion thereof was developed.

Figure 21E:
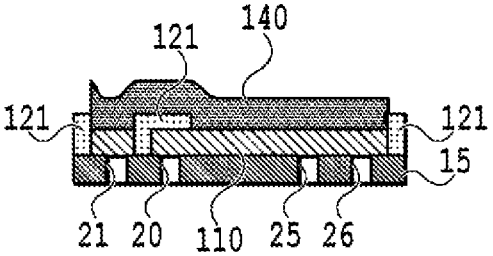
Figure 21F:
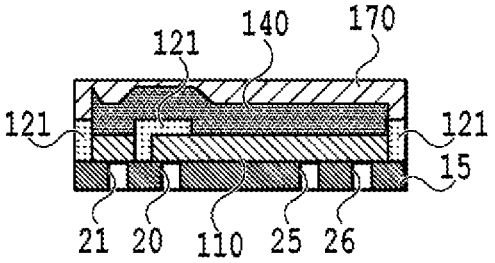

As shown in FIG. 21E, the positive resist ODUR-1010A manufactured by Tokyo Ohka Kogyo Co., Ltd. was deposited as the second pattern 140 on the epoxy resin layer serving as the first covering layer 120. The deposition was conducted by means of coating. Next, an epoxy resin layer was deposited as the second covering layer 160 as shown in FIG. 21F.

Figure 21G:
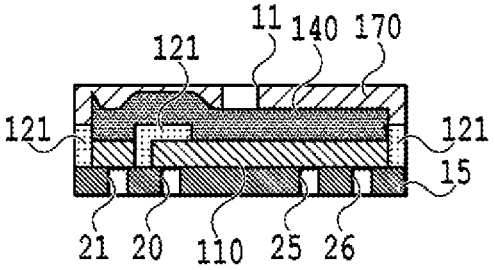
Figure 21H:
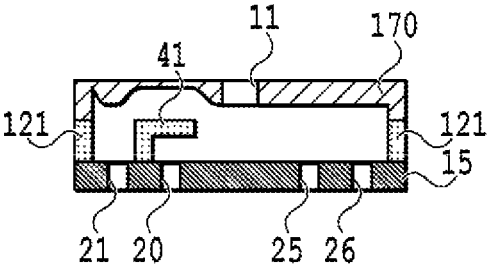

The portion corresponding to the ejection port 11 was subjected to light exposure and development as shown in FIG. 21G. Next, the first pattern 110 and the second pattern 140 were removed as shown in FIG. 21H. The surfaces of the resin layers on the substrate were not flat, and wafer for the head with small thickness distribution on the orifice plate was not successfully manufactured.

Second Reference Example

A liquid ejection head was manufactured in accordance with the following process. The process to deposit the first pattern and the first covering layer was the same as that in the first example. Thereafter, the epoxy resin layer serving as the first covering layer was subjected to light exposure and the unexposed portion thereof was developed. Then, the positive resist ODUR-1010A manufactured by Tokyo Ohka Kogyo Co., Ltd. was formed into a dry film and deposited as the second pattern on the epoxy resin layer. An attempt was made by means of dry film tenting in order to reduce a height difference on the epoxy resin layer serving as the first covering layer, which was developed as a consequence of patterning. However, a tenting region was large and the dry film sagged as a consequence. Next, an epoxy resin layer was deposited as the second covering layer. After conducting the light exposure and the development, the first pattern and the second pattern were removed. The surfaces of the resin layers on the substrate were not flat, and wafer for the head with small thickness distribution on the orifice plate was not successfully manufactured.

Third Embodiment

This embodiment also uses the liquid ejection head 1 and the liquid ejection apparatus shown in FIGS. 1 to 3.

Figure 22A:
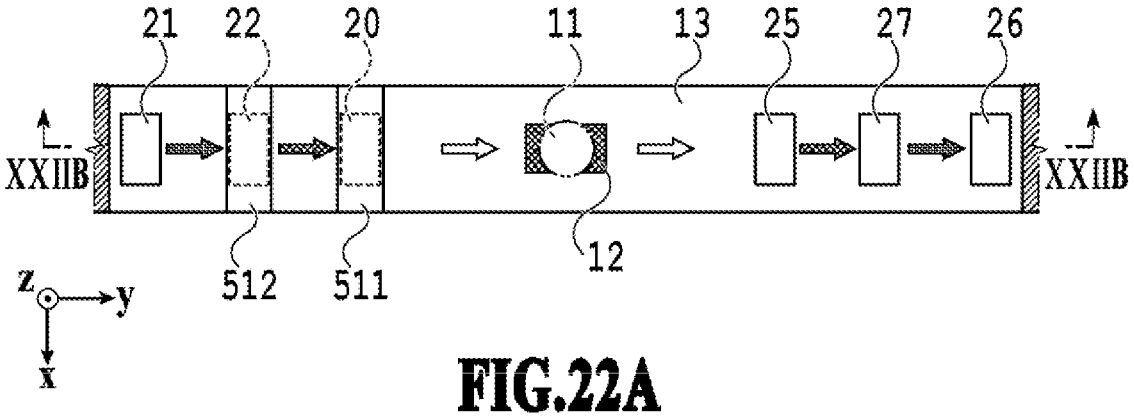
FIGS. 22A and 22B are drawings showing the liquid flow passage formed in the element board.
Figure 22B:
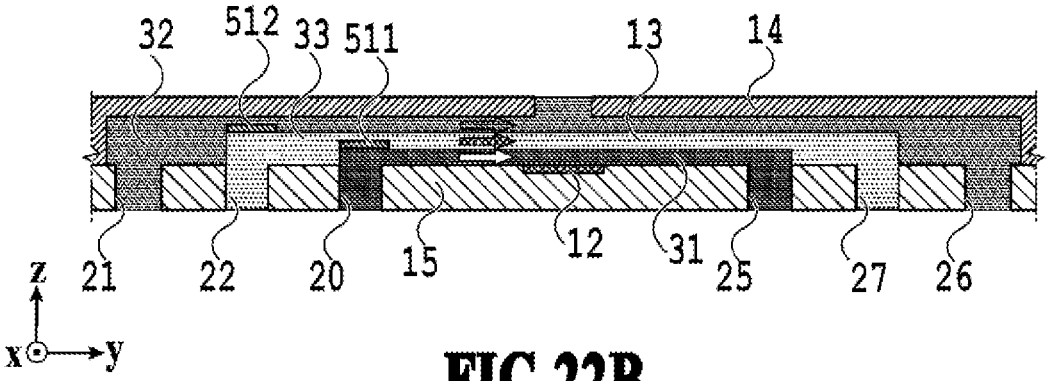
Figure 22C:
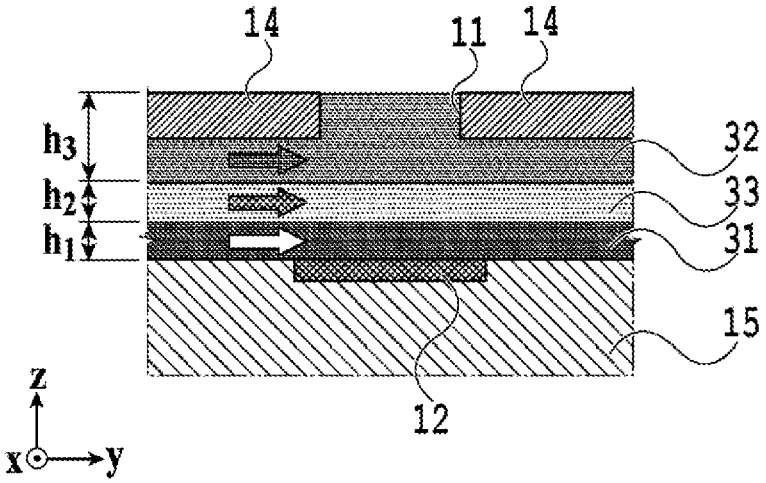
FIG. 22C is an enlarged detail drawing showing the pressure chamber.

FIGS. 22A to 22C are diagrams showing a configuration of the liquid flow passage 13 of this embodiment. The liquid flow passage 13 of this embodiment is different from the liquid flow passages 13 described in the foregoing embodiments in that a third liquid 33 is allowed to flow in the liquid flow passage 13 in addition to the first liquid 31 and the second liquid 32. By allowing the third liquid to flow in the pressure chamber, it is possible to use the bubbling medium with the high critical pressure as the first liquid while using any of the inks of different colors, the high-density resin EM, and the like as the second liquid and the third liquid.

FIG. 22A is a perspective view from the ejection port 11 side (from the +z direction side) and FIG. 22B is a cross-sectional view taken along the XXIIB-XXIIB line in FIG. 22A. In the liquid flow passage 13 of this embodiment, the respective liquids flow in such a way that the third liquid 33 also forms a parallel flow in a state of laminar flow in addition to the parallel flows in the state of laminar flows of the first liquid 31 and the second liquid 32 in the above-described embodiments. In the substrate 15 corresponding to the inner surface (bottom portion) of the liquid flow passage 13, the second inflow port 21, a third inflow port 22, the first inflow port 20, the first outflow port 25, a third outflow port 27, and the second outflow port 26 are formed in this order in the y direction. The pressure chamber 18 including the ejection port 11 and the pressure generating element 12 is located substantially at the center between the first inflow port 20 and the first outflow port 25 in the liquid flow passage 13.

As with the above-described embodiments, the first liquid 31 and the second liquid 32 flow from the first inflow port 20 and the second inflow port 21 into the liquid flow passage 13, then flow in the y direction through the pressure chamber 18, and then flow out of the first outflow port 25 and the second outflow port 26. The third liquid 33 that flows in through the third inflow port 22 is introduced into the liquid flow passage 13, then flows in the liquid flow passage 13 in the y direction, then passes through the pressure chamber 18, and flows out of the third outflow port 27 and is collected. As a consequence, in the liquid flow passage 13, the first liquid 31, the second liquid 32, and the third liquid 33 flow together in the y direction between the first inflow port 20 and the first outflow port 25. In this instance, inside the pressure chamber 18, the first liquid 31 is in contact with the inner surface of the pressure chamber 18 where the pressure generating element 12 is located. Meanwhile, the second liquid 32 forms the meniscus at the ejection port 11 while the third liquid 33 flows between the first liquid 31 and the second liquid 32.

In this embodiment as well, a lateral wall 511 is provided at a position opposed to the first inflow port 20 as with the above-described first embodiment. Moreover, in this embodiment, a lateral wall 512 is provided at a position opposed to the third inflow port 22. These lateral walls 511 and 512 have the same function as that of the lateral wall 51 of the above-described first embodiment. FIG. 22C is an enlarged diagram of the neighborhood of the pressure chamber in FIG. 22B. Provision of the lateral walls 511 and 512 makes it possible to achieve the laminar flows of the first liquid 31, the second liquid 32, and the third liquid 33 in the vertical direction in the pressure chamber 18. Meanwhile, it is also possible to provide the confluence wall 41 as with the above-described second embodiment. The same applies to a case of causing liquids of four or more types to flow in the form of laminar flows in the liquid flow passage 13.

OTHER EMBODIMENTS

The above-described embodiments are based on the structure in which the length L in the width direction of the first inflow port 20 is smaller than the length W in the width direction of the liquid flow passage 13 (L<W). However, there are also a mode in which the length L in the width direction of the first inflow port 20 is equal to the length W in the width direction of the liquid flow passage 13 (L=W), and a mode in which the length L in the width direction of the first inflow port 20 is larger than the length W in the width direction of the liquid flow passage 13 (L>W). In these modes as well, provision of the lateral wall 51 or the confluence wall 41 is effective for forming the liquid-liquid surface such that the first liquid 31 and the second liquid 32 flow in the pressure chamber 18 while being stacked on each other in the vertical direction.

Figure 23A:
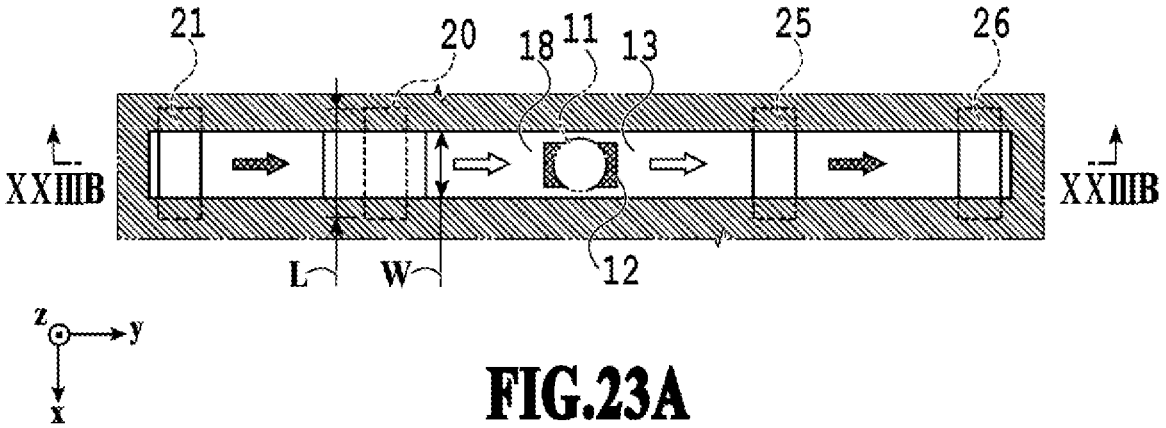
FIGS. 23A and 23B are enlarged detail drawings showing the liquid flow passage and the pressure chamber formed in the element board.
Figure 23B:
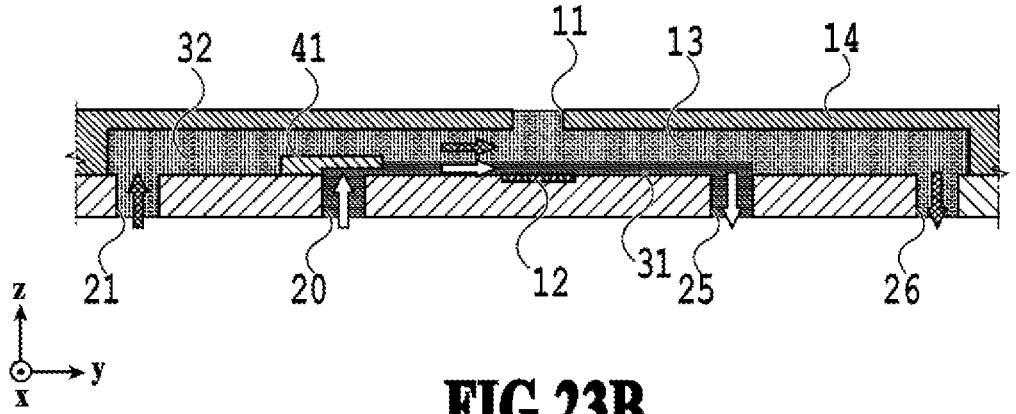

FIGS. 23A and 23B are diagrams showing the above-mentioned mode in which the length L in the width direction of the first inflow port 20 is larger than the length W in the width direction of the liquid flow passage 13 (L>W). FIG. 23A is a perspective view from the ejection port 11 side (from the +z direction side) and FIG. 23B is a cross-sectional view taken along the XXIIIB-XXIIIB line in FIG. 23A. Although FIGS. 23A and 23B illustrate the mode of providing the structure satisfying L>W with the confluence wall 41 and the projection, the structure satisfying L>W may be provided only with the lateral wall 51 as in the first embodiment.

The liquid ejection head and the liquid ejection apparatus including the liquid ejection head according to this disclosure are not limited only to the inkjet printing head and the inkjet printing apparatus configured to eject an ink. The liquid ejection head, the liquid ejection apparatus, and the liquid ejection method of this disclosure are applicable to various apparatuses including a printer, a copier, a facsimile machine equipped with a telecommunication system, and a word processor including a printer unit, and to other industrial printing apparatuses that are integrally combined with various processing apparatuses. In particular, since various liquids can be used as the second liquid, the liquid ejection head, the liquid ejection apparatus, and the liquid ejection method are also adaptable to other applications including biochip fabrication, electronic circuit printing, and so forth.

According to this disclosure, it is possible to stabilize ejection of a liquid serving as an ejection medium by causing a bubbling medium and the ejection medium to flow while being arranged in the height direction in the pressure chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-027393 filed Feb. 19, 2019, and No. 2019-105340 filed Jun. 5, 2019, which are hereby incorporated by reference herein in their entirety.

What is claimed is:

1. A liquid ejection head comprising:

a substrate including a pressure generating element configured to apply pressure to a first liquid;

a member provided with an ejection port configured to eject a second liquid;

a pressure chamber including the ejection port and the pressure generating element; and a liquid flow passage formed by using the substrate and the member stacked on the substrate, the liquid flow passage including the pressure chamber and extending in a direction of flow of at least the first liquid and the second liquid, wherein the substrate includes:

a first inflow port located on an upstream side of the pressure chamber with respect to the direction of flow of the liquids in the liquid flow passage and configured to allow the first liquid to flow into the liquid flow passage, a second inflow port located on the upstream side of the first inflow port and configured to allow the second liquid to flow into the liquid flow passage, and a lateral wall extending in a direction of extension of the liquid flow passage, at least part of the lateral wall being located above the first inflow port, in the pressure chamber, the first liquid flows in contact with the pressure generating element and the second liquid flows closer to the ejection port than the first liquid does, and in the pressure chamber, the first liquid and the second liquid flow in direct contact with each other or a third liquid flows between the first liquid and the second liquid, the third liquid being in direct contact with the first liquid and the second liquid.

2. The liquid ejection head according to claim 1, wherein the first liquid and the second liquid form laminar flows in the pressure chamber.

3. The liquid ejection head according to claim 1, wherein the first liquid and the second liquid form parallel flows in the pressure chamber.

4. The liquid ejection head according to claim 1, wherein an end portion on a downstream side of the lateral wall in the direction of flow of the liquids in the liquid flow passage is located at any of a position above an open end on the downstream side of the first inflow port and a position above a portion of the substrate on the downstream side of the open end on the downstream side of the first inflow port.

5. The liquid ejection head according to claim 1, wherein an end portion on the upstream side of the lateral wall with respect to the direction of flow of the liquids in the liquid flow passage is located at any of a position above an open end on the upstream side of the first inflow port and a position above a portion of the substrate on the upstream side of the open end on the upstream side of the first inflow port.

6. The liquid ejection head according to claim 1, wherein an end portion on the upstream side of the lateral wall with respect to the direction of flow of the liquids in the liquid flow passage is located at a position above a portion of the first inflow port on a downstream side of an open end on the upstream side of the first inflow port with respect to the direction of flow of the liquids in the liquid flow passage.

7. The liquid ejection head according to claim 1, further comprising:

a vertical wall being located on an upstream side of the first inflow port with respect to the direction of flow of the liquids in the liquid flow passage and projecting from a surface of the substrate between the first inflow port and the second inflow port, wherein the lateral wall is a projection projecting downstream from the vertical wall in the direction of flow of the liquids in the liquid flow passage.

8. The liquid ejection head according to claim 7, wherein the lateral wall and the vertical wall are integrally formed.

9. The liquid ejection head according to claim 1, wherein a dimension in a width direction of the lateral wall, the width direction being orthogonal to the direction of flow of the liquids in the liquid flow passage and to a direction from the pressure generating element to the ejection port, is equal to a dimension in the width direction of the liquid flow passage.

10. The liquid ejection head according to claim 1, wherein a dimension in a width direction of the lateral wall, the width direction being orthogonal to the direction of flow of the liquids in the liquid flow passage and to a direction from the pressure generating element to the ejection port, is shorter than a dimension in the width direction of the liquid flow passage.

11. The liquid ejection head according to claim 1, wherein a dimension in a width direction of the liquid flow passage, the width direction being orthogonal to the direction of flow of the liquids in the liquid flow passage and to a direction from the pressure generating element to the ejection port, is shorter than a dimension in the width direction of the first inflow port.

12. The liquid ejection head according to claim 1, wherein a dimension in a width direction of the liquid flow passage, the width direction being orthogonal to the direction of flow of the liquids in the liquid flow passage and to a direction from the pressure generating element to the ejection port, is longer than a dimension in the width direction of the first inflow port.

13. The liquid ejection head according to claim 1, wherein the first liquid is circulated between the pressure chamber and an outside unit.

14. The liquid ejection head according to claim 1, wherein the first liquid has a critical pressure equal to or above 5 MPa.

15. The liquid ejection head according to claim 1, wherein the second liquid is any one of a pigment-containing aqueous ink and an emulsion.

16. The liquid ejection head according to claim 1, wherein the second liquid is any one of a solid ink and an ultraviolet curable ink.

17. A liquid ejection module for constituting the liquid ejection head according to claim 1, wherein the liquid ejection head is formed by arranging a plurality of liquid ejection modules.

18. A method of manufacturing a liquid ejection head including:

a pressure chamber including an ejection port to eject a liquid, a substrate, a liquid flow passage connected to the pressure chamber and configured to allow a first liquid and a second liquid to flow on the substrate, and a wall, the method comprising:

forming a first pattern serving as a mold for the liquid flow passage on the substrate;

forming a first covering layer serving as a formation member for the liquid flow passage and as the wall in such a way as to cover the first pattern with the first covering layer;

forming a second pattern serving as a mold for the liquid flow passage on the first covering layer after subjecting portions of the first covering layer constituting the formation member for the liquid flow passage and constituting the wall to light exposure;

forming a second covering layer serving as a formation member for the liquid flow passage; and forming the liquid flow passage and the wall by:

forming the ejection port by subjecting portions of the second covering layer constituting the ejection port to light exposure and development, and removing the first pattern, the second pattern, and an unexposed portion of the first covering layer after the ejection port is formed.

19. The method of manufacturing a liquid ejection head according to claim 18, wherein the second pattern is formed on the first covering layer without subjecting the unexposed portion of the first covering layer to development after subjecting the first covering layer to light exposure.

* * * * *